US009487893B2

(12) United States Patent
Moore et al.

(10) Patent No.: US 9,487,893 B2
(45) Date of Patent: Nov. 8, 2016

(54) DIMENSIONALLY STABLE NONWOVEN FIBROUS WEBS AND METHODS OF MAKING AND USING THE SAME

(75) Inventors: Eric M Moore, Roseville, MN (US); John D. Stelter, Hudson, WI (US); Michael R. Berrigan, Oakdale, MN (US); Francis E. Porbeni, Woodbury, MN (US); Matthew T. Scholz, Woodbury, MN (US); Kevin D. Landgrebe, Woodbury, MN (US); Sian F. Fennessey, Wettingen (CH); Jay M. Jennen, Forest Lake, MN (US); Korey W. Karls, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1131 days.

(21) Appl. No.: 13/262,400

(22) PCT Filed: Mar. 23, 2010

(86) PCT No.: PCT/US2010/028263

§ 371 (c)(1),
(2), (4) Date: Dec. 15, 2011

(87) PCT Pub. No.: WO2010/117612

PCT Pub. Date: Oct. 14, 2010

(65) Prior Publication Data

US 2012/0088424 A1 Apr. 12, 2012

Related U.S. Application Data

(60) Provisional application No. 61/165,316, filed on Mar. 31, 2009, provisional application No. 61/186,374, filed on Jun. 11, 2009.

(51) Int. Cl.

| | |
|---|---|
| ***D04H 1/55*** | (2012.01) |
| ***D04H 1/544*** | (2012.01) |
| ***D04H 1/4291*** | (2012.01) |
| ***D04H 1/435*** | (2012.01) |
| ***D04H 3/011*** | (2012.01) |
| ***D01F 6/92*** | (2006.01) |
| ***D01F 1/10*** | (2006.01) |

(52) U.S. Cl.

CPC *D04H 1/55* (2013.01); *D01F 1/10* (2013.01); *D01F 6/92* (2013.01); *D04H 1/4291* (2013.01); *D04H 1/435* (2013.01); *D04H 1/544* (2013.01); *D04H 3/011* (2013.01); *Y10T 428/249921* (2015.04); *Y10T 442/68* (2015.04); *Y10T 442/681* (2015.04); *Y10T 442/689* (2015.04)

(58) Field of Classification Search

USPC ..... 442/400–401, 408; 428/373–374, 221; 264/211.14, 171.11

See application file for complete search history.

(56) References Cited

U.S. PATENT DOCUMENTS

| | | | |
|---|---|---|---|
| 1,975,504 | A | 10/1934 | Formhals |
| RE24,906 | E | 12/1960 | Ulrich |
| 3,121,021 | A | 2/1964 | Copeland |
| 3,389,827 | A | 6/1968 | Abere |
| 3,485,706 | A | 12/1969 | Evans |
| 3,565,985 | A | 2/1971 | Schrenk |
| 3,575,782 | A | 4/1971 | Hansen |
| 3,816,229 | A | 6/1974 | Bierbrauber |
| 3,825,379 | A | 7/1974 | Lohkamp |
| 3,825,380 | A | 7/1974 | Harding |
| 3,849,241 | A | 11/1974 | Butin |
| 3,874,886 | A | 4/1975 | Levecque |
| 3,896,251 | A | 7/1975 | Landucci |
| 4,024,178 | A | 5/1977 | Landucci |
| 4,054,592 | A | 10/1977 | Dear |
| 4,103,058 | A | 7/1978 | Humlicek |
| 4,112,213 | A | 9/1978 | Waldman |
| 4,118,531 | A | 10/1978 | Hauser |
| 4,134,951 | A | 1/1979 | Dow |
| 4,310,509 | A | 1/1982 | Berglund |

(Continued)

FOREIGN PATENT DOCUMENTS

| | | |
|---|---|---|
| CN | 1749316 | 3/2006 |
| DE | 10 2007 030159 | 1/2009 |

(Continued)

OTHER PUBLICATIONS

Derwent WPI Publications Ltd., London, GB, AN 1994-322680, XP002065130, Abstract JP 6248551 A (Kuraray Co Ltd) Sep. 6, 1994.

(Continued)

*Primary Examiner* — Lynda Salvatore

(57) ABSTRACT

Dimensionally stable nonwoven fibrous webs include a multiplicity of continuous fibers formed from one or more thermoplastic polyesters and polypropylene in an amount greater than 0% and no more than 10% by weight of the web. The webs have at least one dimension which decreases by no greater than 10% in the plane of the web when heated to a temperature above a glass transition temperature of the fibers. When the thermoplastic polyester is selected to include aliphatic and aromatic polyesters, a spunbond process may be used to produce substantially continuous fibers that exhibit molecular orientation. When the thermoplastic polyester is selected from aliphatic polyesters, a meltblown process may be used to produce discontinuous fibers that do not exhibit molecular orientation. The webs may be used as articles for filtration, sound absorption, thermal insulation, surface cleaning, cellular growth support, drug delivery, personal hygiene, medical apparel, or wound dressing.

16 Claims, No Drawings

(56) References Cited

U.S. PATENT DOCUMENTS

| | | | |
|---|---|---|---|
| 4,323,557 | A | 4/1982 | Rosso |
| 4,363,646 | A | 12/1982 | Torobin |
| 4,401,780 | A | 8/1983 | Steel |
| 4,448,983 | A | 5/1984 | Young |
| 4,477,498 | A | 10/1984 | Deiner |
| 4,536,361 | A | 8/1985 | Torobin |
| 4,540,479 | A | 9/1985 | Sakurai |
| 4,606,737 | A | 8/1986 | Stern |
| 4,668,406 | A | 5/1987 | Chang |
| 4,705,820 | A | 11/1987 | Wang et al. |
| 4,737,410 | A | 4/1988 | Kantner |
| 4,744,365 | A | 5/1988 | Kaplan |
| 4,863,779 | A | 9/1989 | Daponte |
| 5,016,331 | A | 5/1991 | Dilo |
| 5,027,803 | A | 7/1991 | Scholz |
| 5,045,387 | A | 9/1991 | Schmalz |
| 5,227,107 | A | 7/1993 | Dickenson |
| 5,268,733 | A | 12/1993 | Wright |
| 5,364,694 | A | 11/1994 | Okada |
| 5,382,400 | A | 1/1995 | Pike |
| 5,427,842 | A | 6/1995 | Bland |
| 5,475,063 | A | 12/1995 | Kaplan |
| 5,496,507 | A | 3/1996 | Angadjivand |
| 5,496,603 | A | 3/1996 | Riedel |
| 5,502,160 | A | 3/1996 | Modrak |
| 5,525,706 | A | 6/1996 | Gruber |
| 5,585,056 | A | 12/1996 | Liu |
| 5,589,122 | A | 12/1996 | Leonard |
| 5,599,602 | A | 2/1997 | Leonard |
| 5,631,073 | A | 5/1997 | Riedel |
| 5,639,466 | A | 6/1997 | Ford et al. |
| 5,660,922 | A | 8/1997 | Herridge |
| 5,679,190 | A | 10/1997 | Riedel |
| 5,698,322 | A | 12/1997 | Tsai |
| 5,731,062 | A | 3/1998 | Kim |
| 5,741,563 | A | 4/1998 | Mehta |
| 5,753,736 | A | 5/1998 | Bhat |
| 5,833,787 | A | 11/1998 | Ehret |
| 5,883,199 | A | 3/1999 | McCarthy |
| 5,910,368 | A | 6/1999 | Ehret |
| 5,951,993 | A | 9/1999 | Scholz et al. |
| 5,952,088 | A | 9/1999 | Tsai |
| 5,952,433 | A | 9/1999 | Wang |
| 5,997,568 | A | 12/1999 | Liu |
| 6,005,019 | A | 12/1999 | Liu |
| 6,045,908 | A | 4/2000 | Nakajima et al. |
| 6,075,118 | A | 6/2000 | Wang |
| 6,093,792 | A | 7/2000 | Gross |
| 6,111,060 | A | 8/2000 | Gruber |
| 6,114,017 | A | 9/2000 | Fabbricante |
| 6,117,928 | A | 9/2000 | Hiltunen |
| 6,121,170 | A | 9/2000 | Tsai |
| 6,127,485 | A | 10/2000 | Klun |
| 6,143,863 | A | 11/2000 | Gruber |
| 6,183,670 | B1 | 2/2001 | Torobin |
| 6,196,752 | B1 | 3/2001 | Komiyama |
| 6,197,237 | B1 | 3/2001 | Tsai |
| 6,232,280 | B1 | 5/2001 | Shah |
| 6,261,677 | B1 | 7/2001 | Tsai |
| 6,262,180 | B1 | 7/2001 | Klun |
| 6,306,782 | B1 | 10/2001 | Tsai |
| 6,309,988 | B1 | 10/2001 | Tsai |
| 6,315,806 | B1 | 11/2001 | Torobin |
| 6,342,566 | B2 | 1/2002 | Burkhardt |
| 6,382,526 | B1 | 5/2002 | Reneker |
| 6,384,142 | B1 | 5/2002 | Burkhardt |
| 6,482,341 | B1 | 11/2002 | Jongboom |
| 6,506,873 | B1 | 1/2003 | Ryan |
| 6,515,054 | B1 | 2/2003 | Matsushita |
| 6,548,431 | B1 | 4/2003 | Bansal et al. |
| 6,645,618 | B2 | 11/2003 | Hobbs |
| 6,743,273 | B2 | 6/2004 | Chung |
| 6,787,493 | B1 | 9/2004 | Nagaoka |
| 6,800,226 | B1 | 10/2004 | Gerking |
| 6,861,025 | B2 | 3/2005 | Erickson |
| 6,905,987 | B2 | 6/2005 | Noda et al. |
| 6,916,480 | B2 | 7/2005 | Anderson |
| 6,916,752 | B2 | 7/2005 | Berrigan |
| 6,949,288 | B2 * | 9/2005 | Hodge et al. ..... 428/370 |
| 6,960,642 | B2 | 11/2005 | Jariwala |
| 7,195,658 | B2 | 3/2007 | Swei et al. |
| 7,199,197 | B2 | 4/2007 | Caldwell |
| 7,241,838 | B2 | 7/2007 | Shelby |
| 7,456,306 | B2 | 11/2008 | Wolfgang et al. |
| 7,604,859 | B2 | 10/2009 | Liu |
| 7,623,339 | B2 | 11/2009 | Takahashi |
| 7,767,120 | B2 | 8/2010 | Yahata et al. |
| 7,837,814 | B2 | 11/2010 | Minami et al. |
| 8,287,509 | B2 | 10/2012 | Joubert et al. |
| 8,721,943 | B2 | 5/2014 | Moore et al. |
| 8,858,986 | B2 | 10/2014 | Scholz et al. |
| 8,932,704 | B2 | 1/2015 | Porbeni et al. |
| 2002/0188041 | A1 * | 12/2002 | Bond et al. ..... 524/47 |
| 2004/0009210 | A1 | 1/2004 | Koenig et al. |
| 2004/0024141 | A1 | 2/2004 | Hasebe |
| 2004/0045145 | A1 | 3/2004 | Wang |
| 2004/0096656 | A1 | 5/2004 | Bond |
| 2004/0126578 | A1 | 7/2004 | Tsai et al. |
| 2004/0241216 | A1 | 12/2004 | Klun |
| 2004/0265516 | A1 | 12/2004 | Schulz |
| 2005/0026802 | A1 | 2/2005 | Kilkenny et al. |
| 2005/0048152 | A1 | 3/2005 | Gerking |
| 2005/0136781 | A1 | 6/2005 | Lassig et al. |
| 2005/0233142 | A1 | 10/2005 | Takahashi et al. |
| 2006/0058470 | A1 | 3/2006 | Rizk |
| 2006/0058868 | A1 | 3/2006 | Gale et al. |
| 2006/0084340 | A1 | 4/2006 | Bond |
| 2006/0273495 | A1 | 12/2006 | Topolkaraev |
| 2006/0276092 | A1 | 12/2006 | Topolkaraev |
| 2007/0270071 | A1 | 11/2007 | Greer |
| 2008/0038976 | A1 | 2/2008 | Berrigan |
| 2008/0086199 | A1 | 4/2008 | Dave |
| 2008/0142023 | A1 | 6/2008 | Schmid |
| 2008/0160861 | A1 | 7/2008 | Berrigan |
| 2008/0200890 | A1 | 8/2008 | Wood |
| 2008/0213595 | A1 | 9/2008 | Levitt |
| 2011/0065573 | A1 | 3/2011 | McEneany et al. |
| 2011/0151737 | A1 | 6/2011 | Moore et al. |
| 2011/0189463 | A1 * | 8/2011 | Moore et al. ..... 428/304.4 |
| 2012/0040185 | A1 | 2/2012 | Topolkaraev et al. |
| 2012/0077886 | A1 | 3/2012 | Scholz et al. |
| 2013/0210308 | A1 | 8/2013 | McEneany et al. |
| 2013/0210949 | A1 | 8/2013 | Scholl et al. |
| 2013/0288556 | A1 | 10/2013 | Moore et al. |
| 2014/0210141 | A1 | 7/2014 | Moore et al. |
| 2015/0004866 | A1 | 1/2015 | Scholz et al. |

FOREIGN PATENT DOCUMENTS

| | | |
|---|---|---|
| EP | 0 527 489 | 2/1993 |
| EP | 569154 | 11/1993 |
| EP | 669358 | 8/1995 |
| EP | 1200661 | 7/2004 |
| EP | 1097967 | 12/2004 |
| EP | 1 604 813 | 12/2005 |
| EP | 1721927 | 11/2006 |
| EP | 1862507 | 12/2007 |
| JP | S56-159339 | 12/1981 |
| JP | H5-51852 | 3/1993 |
| JP | 61-66943 | 6/1994 |
| JP | H6-166943 | 6/1994 |
| JP | H06-184817 | 7/1994 |
| JP | H07-048768 | 2/1995 |
| JP | 10-17757 | 1/1998 |
| JP | H10-036652 | 2/1998 |
| JP | H11-131354 | 5/1999 |
| JP | 2000-96416 | 4/2000 |
| JP | 2000-136479 | 5/2000 |
| JP | 2003-245510 | 9/2003 |
| JP | 2004-532360 | 10/2004 |
| JP | H06-285112 | 10/2004 |
| JP | 2006-028726 | 2/2006 |
| JP | 2006-183180 | 7/2006 |
| JP | 2007-197857 | 8/2007 |

(56) References Cited

FOREIGN PATENT DOCUMENTS

| | | |
|---|---|---|
| JP | 2007 197857 | 8/2007 |
| JP | 2008-535955 | 9/2008 |
| JP | 4-319169 | 8/2009 |
| JP | 2009-221618 | 10/2009 |
| KR | 10-1999-0076593 | 7/1997 |
| KR | 10-0640138 | 10/2006 |
| WO | WO 84-04311 | 11/1984 |
| WO | WO 94-07941 | 4/1994 |
| WO | WO 94-07949 | 4/1994 |
| WO | WO 96-22330 | 7/1996 |
| WO | WO 97-19991 | 6/1997 |
| WO | WO 98-24951 | 6/1998 |
| WO | WO 98/29585 | 7/1998 |
| WO | WO 98-50611 | 11/1998 |
| WO | WO 99-06456 | 2/1999 |
| WO | WO 99-50345 | 10/1999 |
| WO | WO 00-12606 | 3/2000 |
| WO | WO 01-09425 | 2/2001 |
| WO | WO 01-14621 | 3/2001 |
| WO | WO 01/46507 | 6/2001 |
| WO | WO 01/48303 | 7/2001 |
| WO | WO 03-040201 | 5/2003 |
| WO | WO 2004/045663 | 6/2004 |
| WO | WO 2006/129731 | 12/2006 |
| WO | WO 2006-130211 | 12/2006 |
| WO | WO 2006/130211 | 12/2006 |
| WO | WO 2008-038350 | 4/2008 |
| WO | WO 2008/073099 | 6/2008 |
| WO | WO 2009/078849 | 6/2009 |
| WO | WO 2009-152345 | 12/2009 |
| WO | WO 2009-152349 | 12/2009 |
| WO | WO 2010-021911 | 2/2010 |
| WO | WO 2011-075619 | 6/2011 |
| WO | WO 2011-084670 | 7/2011 |
| WO | WO 2014/059239 A1 | 4/2014 |

OTHER PUBLICATIONS

Ellison, C.J. et al.; "Melt blown nanofibers: Fiber diameter distributions and onset of fiber breakup"; Polymer; vol. 48; 2007; pp. 3306-3316.

Bansal, "On-Line Determination of Density and Crystallinity During Melt Spinning", *Polymer Engineering and Science*, Nov. 1996, vol. 36, No. 2, pp. 2785-2798.

Davies, "The Separation of Airborne Dust and Particles", Inst. of Mech. Engineers Proceedings, vol. 1B, 1952, pp. 185-198.

Fenner, "Principles of Polymer Processing", 1979, pp. 77-84.

Fink, "Ziegler Catalysts—Recent Scientific Innovations and Technological Improvements", Springer-Verlag, Berlin Heidelberg, 1995, 5 pages.

Gedde, "Polymer Physics", 1st Ed. Chapman & Hall, London, 1996, pp. 298.

Gokel, "Dean's Handbook of Organic Chemistry—Section 1 Organic Compounds", Second Edition, Kenneth P. McCombs, McGraw-Hill, 2004, pp. 1.18-1.22.

Kricheldorf, Chemosphere—Synthesis and Application of Polylactides, vol. 43, 2001, pp. 49-54.

Leenslag, "Resorbable Materials of Poly(L-lactide). V. Influence of Secondary Structure on the Mechanical Properties and Hydrolyzability of Poly(L-lactide) Fibers Produced by a Dry-Spinning Method", *Journal of Applied Polymer Science*, vol. 29, 1984, pp. 2829-2842.

Mezghani, "High Speed Melt Spinning of Poly(L-lactic acid) Filaments", *Journal of Polymer Science, Part B: Polymer Physics*, 1998, vol. 36,pp. 1005-1012.

Narayanan, Nonwovens Conference and Trade Fair, TAPPI Proceedings,"Dimensional Stability of Melt Blown Polyester Nonwovens", Mar. 9-11, 1998, pp. 29-36.

Resconi, "Selectivity in Propene Polymerization with Metallocene Catalysts" Chem. Rev., Mar. 25, 2000, vol. 100, pp. 1253-1345.

Scheirs, "Metallocene-based Polyolefins", vol. 1 and "Polyolefins", vol. 2, 2000, Wiley & Sons, Chichester, England, 10 pages.

Schmack, "High-Speed Melt Spinning of Various Grades of Polylactides", Journal of Applied Polymer Science,2004, vol. 91, pp. 800-806.

Solarski, "Characterization of the thermal properties of PLA fibers by modulated differential scanning calorimetry", *Polymer*, 2005, vol. 46, No. 25, pp. 11187-11192.

Takasaki, "Structural Development of Polylactides with Various d-Lactide contents in the High-Speed Melt Spinning Process", Journal of Macromolecular Science, *Part B-Physics*, 2003, vol. B42, No. 1, pp. 57-73.

Tsuji, "Stereocomplex formation between enantiomeric poly(lactic acid)s. XI. Mechanical properties and morphology of solution-cast films", Polymer, 1999, vol. 40, pp. 6699-6708.

Wente, "Manufacture of Superfine Organic Fibers", Report No. 4364 of the Naval Research Laboratories, Washington, D.C., .May 25, 1954, 22 pages.

Wente, "Superfine Thermoplastic Fibers", Industrial and Engineering Chemistry, 1956, vol. 48, pp. 1342-1346.

Ziabicki, "Fundamentals of Fibre Formation: The Science of Fibre Spinning and Drawing", John Wiley & Sons, 1976, 3 pages.

International Search Report, PCT/US2009/047057, Date mailed Jul. 31, 2009, 3 pages.

International Search Report, PCT/US2009/047064, Date mailed Aug. 25, 2009, 5 pages.

International Search Report, PCT/US2010/60951, Date mailed Feb. 11, 2011, 11 pages.

International Search Report, PCT/US2010/60957, Date Mailed Feb. 28, 2011, 6 pages.

PCT/US2011/056257 application, filed Oct. 14, 2011, entitled Dimensionally Stable Nonwoven Fibrous Webs, and Methods of Making and Using the Same.

Silver Fern Chemical, Calcium Stearate, http://www.silverfernchemical.com/products/calcium-stearate, copyright 2014; 3 pgs.

Wikipedia.com, Surfactant, http://en.wikipedia.org/wiki/Surfactant, copyright 2014; 11 pgs.

Lee, J. et al. ; "Combined effect of oleic acid and polyethylene glycol 200 on buccal permeation of [D-Ala$^2$ , D-Leu$^5$ ]enkephalin from a cubic phase of glyceryl monooleate"; International Journal of Pharmaceutics; vol. 204; 2000; pp. 137-144.

U.S. Appl. No. 62/069,934, filed Oct. 29, 2014, Chakravarty et al.

Product Data Sheet on Calcium Stearate from Pratham Stearchem Pvt, Ltd; 2010; 1 pg.

Ndaro et al., "Splitting of Island-in-the-Sea Fibers (PA6/COPET) During Hydroentangling of Nonwovens," *J Eng Fiber Fabr*, 2007;2(4):1-9.

* cited by examiner

DIMENSIONALLY STABLE NONWOVEN FIBROUS WEBS AND METHODS OF MAKING AND USING THE SAME

CROSS REFERENCE TO RELATED APPLICATIONS

This application is a national stage filing under 35 U.S.C. 371 of PCT/US2010/028263, filed Mar. 23, 2010, which claims priority to U.S. Patent Application No. 61/165,316, filed Mar. 31, 2009 and U.S. Patent Application No. 61/186,374, filed Jun. 11, 2009, the disclosures of which are incorporated by reference in its/their entirety herein.

TECHNICAL FIELD

The present disclosure relates to dimensionally stable nonwoven fibrous webs and methods of making and using such webs. The disclosure further relates to dimensionally stable nonwoven fibrous webs including blends of polypropylene and an aliphatic and/or aromatic polyester useful in making articles, such as biodegradable and biocompatible articles.

BACKGROUND

Melt-spinning (or spunbond processing) is the process of forming fibers by extruding molten polymer through small orifices in a die, collecting the spun filaments on a belt in a uniform random fashion, and bonding the fibers to form a cohesive web. Melt-blowing (or MB) is the process of forming fibers by extruding molten polymer through small orifices surrounded by high speed heated gas jets, and collecting the blown filaments as a cohesive web. This process is also referred to as a blown micro fiber (or BMF) process.

Polyesters such as poly(ethylene) terephthalate (PET) and polyolefins such as poly(propylene) (PP) are two commonly used classes of petroleum based polymers in the commercial production of textile fibers, packaging films, beverage bottles, and injection molded goods by processes such as BMF and spunbond. Although PET has a higher melting point and superior mechanical and physical properties compared to other commercially useful polymers, it exhibits poor dimensional stability at temperatures above its glass transition temperature. Polyester fibers, e.g. aromatic polyesters such as PET and poly(ethylene) terephthalate glycol (PETG), and/or aliphatic polyesters such as poly(lactic acid) (PLA), and webs including such fibers, may shrink up to 40% of the original length when subjected to elevated temperatures due to the relaxation of the oriented amorphous segments of the molecules to relax upon exposure to heat (See Narayanan, V.; Bhat, G. S, and L. C. Wadsworth. *TAPPI Proceedings: Nonwovens Conference & Trade Fair*. (1998) 29-36).

Furthermore, PET has generally not been considered as suitable for applications involving high-speed processing because of its slow crystallization from the melt state; at commercial production rates, the polymer has minimal opportunity to form well developed crystallites. Articles prepared from PET fibers typically need to undergo an additional stage of drawing and heat-setting (e.g. annealing) during the fiber spinning process to dimensionally stabilize the produced structure.

Additionally, there is also a growing interest in replacing petroleum based polymers such as PET and PP with resource renewable polymers, i.e. polymers derived from plant based materials. Ideal resource renewable polymers are "carbon dioxide neutral" meaning that as much carbon dioxide is consumed in growing the plants base material as is given off when the product is made and disposed of. Biodegradable materials have adequate properties to permit them to break down when exposed to conditions which lead to composting. Examples of materials thought to be biodegradable include aliphatic polyesters such as PLA, poly(glycolic acid), poly(caprolactone), copolymers of lactide and glycolide, poly(ethylene succinate), and combinations thereof.

However, difficulty is often encountered in the use of aliphatic polyesters such as poly(lactic acid) for BMF due to aliphatic polyester thermoplastics having relatively high melt viscosities which yields nonwoven webs that generally cannot be made at the same fiber diameters that polypropylene can. The coarser fiber diameters of polyester webs can limit their application as many final product properties are controlled by fiber diameter. For example, course fibers lead to a noticeably stiffer and less appealing feel for skin contact applications. Furthermore, course fibers produce webs with larger porosity that can lead to webs that have less of a barrier property, e.g., less repellency to aqueous fluids.

The processing of aliphatic polyesters as microfibers has been described in U.S. Pat. No. 6,645,618 (Hobbs et al.). U.S. Pat. No. 6,111,160 (Gruber et al.) discloses the use of melt stable polylactides to form nonwoven articles via melt blown and spunbond processes. JP6466943A (Shigemitsu et al.) describes a low shrinkage-characteristic polyester system and its manufacture approach. U.S. Patent Application Publication No. 2008/0160861 (Berrigan et al.) describes a method for making a bonded nonwoven fibrous web comprising extruding melt blown fibers of a polyethylene terephthalate and polylactic acid, collecting the melt blown fibers as an initial nonwoven fibrous web, and annealing the initial nonwoven fibrous web with a controlled heating and cooling operation. U.S. Pat. No. 5,364,694 (Okada et al.) describes a polyethylene terephthalate (PET) based melt-blown nonwoven fabric and its manufacture. U.S. Pat. No. 5,753,736 (Bhat et al.) describes the manufacture of polyethylene terephthalate fiber with reduced shrinkage through the use of nucleation agent, reinforced and a combination of both. U.S. Pat. Nos. 5,585,056 and 6,005,019 describe a surgical article comprising absorbable polymer fibers and a plasticizer containing stearic acid and its salts.

SUMMARY

In general, the presently disclosed invention relates to dimensionally stable nonwoven fibrous webs and methods of making and using such webs. In one aspect, the disclosure relates to a web including a plurality of continuous fibers comprising one or more thermoplastic polyesters selected from aliphatic polyesters and aromatic polyesters; and polypropylene in an amount greater than 0% and no more than 10% by weight of the web, wherein the fibers exhibit molecular orientation and extend substantially endlessly through the web, and further wherein the web has at least one dimension which decreases by no greater than 10% in the plane of the web when the web is heated to a temperature above a glass transition temperature of the fibers, but below the melting point of the fibers. In some exemplary embodiments, the molecular orientation of the fibers results in a bi-refringence value of at least 0.01. In most embodiments, the fibers are microfibers, and particularly fine fibers.

In some exemplary embodiments, the thermoplastic polyester comprises at least one aromatic polyester. In certain exemplary embodiments, the aromatic polyester is selected from poly(ethylene) terephthalate (PET), poly(ethylene) terephthalate glycol (PETG), poly(butylene) terephthalate (PBT), poly(trimethyl) terephthalate (PTT), their copolymers, or combinations thereof. In other exemplary embodiments, the thermoplastic polyester comprises at least one aliphatic polyester. In certain exemplary embodiments, the aliphatic polymer is selected from one or more poly(lactic acid), poly(glycolic acid), poly(lactic-co-glycolic acid), polybutylene succinate, polyhydroxy-butyrate, polyhydroxyvalerate, blends, and copolymers thereof. In certain exemplary embodiments, the aliphatic polyester is semicrystalline.

In another aspect, the disclosure relates to a web including a plurality of fibers comprising one or more thermoplastic polyesters selected from aliphatic polyesters; and polypropylene in an amount greater than 0% and no more than 10% by weight of the web, wherein the fibers do not exhibit molecular orientation, and further wherein the web has at least one dimension which decreases by no greater than 10% in the plane of the web when the web is heated to a temperature above a glass transition temperature of the fibers, but below the melting point of the fibers. In certain exemplary embodiments, the thermoplastic polyester comprises at least one aliphatic polyester selected from the group consisting of one or more poly(lactic acid), poly(glycolic acid), poly(lactic-co-glycolic acid), polybutylene succinate, polyhydroxy-butyrate, polyhydroxyvalerate, blends, and copolymers thereof. In certain exemplary embodiments, the aliphatic polyester is semicrystalline. In most embodiments, the fibers are microfibers, particularly fine fibers.

In additional exemplary embodiments related to both of the previously described aspects of the disclosure, the plurality of fibers may comprise a thermoplastic (co)polymer distinct from the thermoplastic polyester. In further exemplary embodiments, the fibers may comprise at least one of a plasticizer, a diluent, a surfactant, a viscosity modifier, an antimicrobial component, or combinations thereof. In some particular exemplary embodiments, the fibers exhibit a median fiber diameter of no greater than about 25 μm. In certain of these embodiments, the fibers exhibit a median fiber diameter of at least 1 μm. In additional exemplary embodiments, the web is biocompatible.

In further embodiments, dimensionally stable fibrous nonwoven webs may be formed by use of a viscosity modifier to reduce the viscosity of aliphatic polyesters, such as PLA. In certain exemplary embodiments, the viscosity modifier is selected from the group consisting of alkyl carboxylates, alkenyl carboxylates, aralkyl carboxylates, alkylethoxylated carboxylates, aralkylethoxylated carboxylates, alkyl lactylates, alkenyl lactylates, and mixtures thereof.

In some exemplary embodiments, the web is a dimensionally stable nonwoven fibrous web formed from a molten mixture of the thermoplastic polyester and the polypropylene. In further exemplary embodiments, the dimensionally stable nonwoven fibrous web is selected from the group consisting of a spunbond web, a blown microfiber web, a hydroentangled web, or combinations thereof.

In a further aspect, the disclosure relates to a method of making a dimensionally stable nonwoven fibrous web comprising forming a mixture of one or more thermoplastic polyesters selected from aliphatic polyesters and aromatic polyesters with polypropylene in an amount greater than 0% and no more than 10% by weight of the mixture; forming a plurality of fibers from the mixture; and collecting at least a portion of the fibers to form a web, wherein the fibers exhibit molecular orientation and extend substantially endlessly through the web, and further wherein the web has at least one dimension in the plane of the web which decreases by no greater than 10% when the web is heated to a temperature above a glass transition temperature of the fibers, but below the melting point of the fibers. In some embodiments, the fibers may be formed using melt-spinning, filament extrusion, electrospinning, gas jet fibrillation or combinations thereof.

In still another aspect, the disclosure relates to a method of making a dimensionally stable nonwoven fibrous web comprising forming a mixture of one or more thermoplastic aliphatic polyesters with polypropylene in an amount greater than 0% and no more than 10% by weight of the mixture; forming a plurality of fibers from the mixture; and collecting at least a portion of the fibers to form a web, wherein the fibers do not exhibit molecular orientation, and further wherein the web has at least one dimension which decreases by no greater than 10% in the plane of the web when the web is heated to a temperature above a glass transition temperature of the fibers, but below the melting point of the fibers. In some exemplary embodiments, the fibers may be formed using a melt-blowing (e.g. BMF) process.

In some exemplary embodiments, the methods may further comprise post healing the dimensionally stable nonwoven fibrous web, for example, by controlled heating or cooling of the web.

In a further aspect, the disclosure relates to an article comprising a dimensionally stable nonwoven fibrous web as described above, wherein the article is selected from a gas filtration article, a liquid filtration article, a sound absorption article, a thermal insulation article, a surface cleaning article, a cellular growth support article, a drug delivery article, a personal hygiene article, a wound dressing article, and a dental hygiene article. In certain exemplary embodiments, the article may be a surgical drape. In other exemplary embodiments, the article may be a surgical gown. In other exemplary embodiments, the article may be a sterilization wrap. In further exemplary embodiments, the article may be a wound contact material.

Exemplary embodiments of the dimensionally stable nonwoven fibrous webs according to the present disclosure may have structural features that enable their use in a variety of applications, have exceptional absorbent properties, exhibit high porosity and permeability due to their low Solidity, and/or be manufactured in a cost-effective manner. Due to the small diameter of the fibers formed, the webs may have a soft feel similar to polyolefin webs but in many cases exhibit superior tensile strength due to the higher modulus of the polyester used.

Bi-component fibers, such as core-sheath or side-by-side bi-component fibers, may be prepared, as may be bicomponent microfibers, including sub-micrometer fibers. However, exemplary embodiments of the disclosure may be particularly useful and advantageous with monocomponent fibers. Among other benefits, the ability to use monocomponent fibers reduces complexity of manufacturing and places fewer limitations on use of the web.

Exemplary methods of producing dimensionally stable nonwoven fibrous webs according to the present disclosure may have advantages in terms of higher production rate, higher production efficiency, lower production cost, and the like.

Various aspects and advantages of exemplary embodiments of the present invention have been summarized. The above Summary is not intended to describe each illustrated embodiment or every implementation of the present invention. The Detailed Description and the Examples that follow more particularly exemplify certain presently preferred embodiments using the principles disclosed herein.

DETAILED DESCRIPTION

The present disclosure relates generally to dimensionally stable nonwoven fibrous webs or fabrics. The webs include a plurality of fibers formed from a (co)polymer mixture that is preferably melt processable, such that the (co)polymer mixture is capable of being extruded. Dimensionally stable nonwoven fibrous webs may be prepared by blending an aliphatic and/or aromatic polyester with polypropylene (PP) in an amount greater than 0% and no more than 10% by weight of the web, before or during extrusion. The resulting webs have at least one dimension which decreases by no greater than 10% in the plane of the web, when the web is heated to a temperature above a glass transition temperature of the fibers. In certain embodiments, the fibers may exhibit molecular orientation.

In the plane of the web refers to the x-y plane of the web, which may also be referred to as the machine direction and/or cross direction of the web. Thus, fibers and webs described herein have at least one dimension in the plane of the web, e.g., the machine or the cross direction, that decreases by no greater than 10%, when the web is heated to a temperature above a glass transition temperature of the fibers.

The fibrous webs or fabrics as described herein are dimensionally stable when the web is heated to a temperature above a glass transition temperature of the fibers. The webs may be heated 15° C., 20° C., 30° C., 45° C. and even 55° C. above the glass transition temperature of the aromatic and/or aliphatic polyester fibers, and the web will remain dimensionally stable, e.g., having at least one dimension which decreases by no greater than 10% in the plane of the web. The web should not be heated to a temperature that melts the fibers, or causes the fibers to appreciably degrade, as demonstrated by such characteristics as loss of molecular weight or discoloration.

While not intending to be bound by theory, it is believed that aggregates of PP may thereby be evenly distributed through the core of the filament; the polyolefin is believed to act as a selectively miscible additive. At low weight percents of the web, PP mixes with the polyester and physically inhibits chain movement, thereby suppressing cold crystallization, and macroscopic shrinkage is not observed. If the weight percent of the PP is increased further beyond 10 percent by weight, the PP and polyester phase separate and rearrangement of the polyester is not affected.

As used in this specification and the appended claims, the singular forms "a", "an", and "the" include plural referents unless the content clearly dictates otherwise. Thus, for example, reference to fine fibers containing "a compound" includes a mixture of two or more compounds. As used in this specification and the appended claims, the term "or" is generally employed in its sense including "and/or" unless the content clearly dictates otherwise.

As used in this specification, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques.

For the following defined terms, these definitions shall be applied, unless a different definition is given in the claims or elsewhere in the specification.

Glossary

The term "bi-component fiber" or "multi-component fiber" means fibers with two or more components, each component occupying a part of the cross-sectional area of the fiber and extending over a substantial length of the fiber. Suitable multi-component fiber configurations include, but are not limited to, a sheath-core configuration, a side-by-side configuration, and an "islands-in-the-sea" configuration (for example, fibers produced by Kuraray Company, Ltd., Okayama, Japan).

The term "monocomponent fiber" means fibers in which the fibers have essentially the same composition across their cross-section, but monocomponent includes blends or additive-containing materials, in which a continuous phase of substantially uniform composition extends across the cross-section and over the length of the fiber.

The term "biodegradable" means degradable by the action of naturally occurring microorganisms such as bacteria, fungi and algae and/or natural environmental factors such as hydrolysis, transesterification, exposure to ultraviolet or visible light (photodegradable) and enzymatic mechanisms or combinations thereof.

The term "biocompatible" means biologically compatible by not producing toxic, injurious or immunological response in living tissue. Biocompatible materials may also be broken down by biochemical and/or hydrolytic processes and absorbed by living tissue. Test methods used include ASTM F719 for applications where the fine fibers contact tissue such as skin, wounds, mucosal tissue including in an orifice such as the esophagus or urethra, and ASTM F763 for applications where the fine fibers are implanted in tissue.

The term "median fiber diameter" means fiber diameter determined by producing one or more images of the fiber structure, such as by using a scanning electron microscope; measuring the fiber diameter of clearly visible fibers in the one or more images resulting in a total number of fiber diameters, x; and calculating the median fiber diameter of the x fiber diameters. Typically, x is greater than about 20, more preferably greater than about 50, and desirably ranges from about 50 to about 200.

The term "fine fiber" generally refers to fibers having a median fiber diameter of no greater than about 50 micrometers (μm), preferably no greater than 25 μm, more preferably no greater than 20 μm, still more preferably no greater than 15 μm, even more preferably no greater than 10 μm, and most preferably no greater than 5 μm.

"Microfibers" are a population of fibers having a median fiber diameter of at least one μm but no greater than 100 μm.

"Ultrafine microfibers" are a population of microfibers having a median fiber diameter of 2 μm or less.

"Sub-micrometer fibers" are a population of fibers having a median fiber diameter of no greater than one μm.

When reference is made herein to a batch, group, array, etc. of a particular kind of microfiber, e.g., "an array of sub-micrometer fibers," it means the complete population of microfibers in that array, or the complete population of a single batch of microfibers, and not only that portion of the array or batch that is of sub-micrometer dimensions.

"Continuous oriented microfibers" herein refers to essentially continuous fibers issuing from a die and traveling through a processing station in which the fibers are drawn and at least portions of the molecules within the fibers are oriented into alignment with the longitudinal axis of the fibers ("oriented" as used with respect to fibers means that at least portions of the molecules of the fibers are aligned along the longitudinal axis of the fibers).

"Melt-blown fibers" herein refers to fibers prepared by extruding molten fiber-forming material through orifices in a die into a high-velocity gaseous stream, where the extruded material is first attenuated and then solidifies as a mass of fibers.

"Separately prepared sub-micrometer fibers" means a stream of sub-micrometer fibers produced from a sub-micrometer fiber-forming apparatus (e.g., a die) positioned such that the sub-micrometer fiber stream is initially spatially separate (e.g., over a distance of about 1 inch (25 mm) or more from, but will merge in flight and disperse into, a stream of larger size microfibers.

"Autogenous bonding" is defined as bonding between fibers at an elevated temperature as obtained in an oven or with a through-air bonder without application of direct contact pressure such as in point-bonding or calendering.

"Molecularly same" polymer refers to polymers that have essentially the same repeating molecular unit, but which may differ in molecular weight, method of manufacture, commercial form, etc.

"Self supporting" or "self sustaining" in describing a web means that the web can be held, handled and processed by itself, e.g., without support layers or other support aids.

"Solidity" is a nonwoven web property inversely related to density and characteristic of web permeability and porosity (low Solidity corresponds to high permeability and high porosity), and is defined by the equation:

$$\text{Solidity (\%)} = \frac{[3.937 * \text{Web Basis Weight (g/m}^2)]}{[\text{Web Thickness } (mils) * \text{Bulk Density (g/cm}^3)]}$$

"Web Basis Weight" is calculated from the weight of a 10 cm×10 cm web sample.

"Web Thickness" is measured on a 10 cm×10 cm web sample using a thickness testing gauge having a tester foot with dimensions of 5 cm×12.5 cm at an applied pressure of 150 Pa.

"Bulk Density" is the bulk density of the polymer or polymer blend that makes up the web, taken from the literature.

Various exemplary embodiments of the disclosure will now be described. Exemplary embodiments of the present invention may take on various modifications and alterations without departing from the spirit and scope of the disclosure. Accordingly, it is to be understood that the embodiments of the present invention are not to be limited to the following described exemplary embodiments, but is to be controlled by the limitations set forth in the claims and any equivalents thereof.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the present invention. Thus, the appearances of the phrases such as "in one or more embodiments," "in certain embodiments," "in one embodiment" or "in an embodiment" in various places throughout this specification are not necessarily referring to the same embodiment of the present invention. Furthermore, the particular features, structures, materials, or characteristics may be combined in any suitable manner in one or more embodiments.

A. Dimensionally Stable Nonwoven Fibrous Webs

In some embodiments, dimensionally stable nonwoven webs may be formed from a molten mixture of a thermoplastic polyester and a polypropylene. In certain embodiments, the dimensionally stable nonwoven webs may be a spunbond web, a blown microfiber web, a hydroentangled web, or combinations thereof.

1. Molecularly Oriented Fibers

In certain embodiments, dimensionally stable nonwoven fibrous webs can be prepared by fiber-forming processes in which filaments of fiber-forming material are formed by extrusion of a mixture of one or more thermoplastic polyesters selected from aliphatic and aromatic polyesters with polypropylene in an amount greater than 0% and no more than 10% by weight of the mixture, subjected to orienting forces, and passed through a turbulent field of gaseous currents while at least some of the extruded filaments are in a softened condition and reach their freezing temperature (e.g., the temperature at which the fiber-forming material of the filaments solidifies) while in the turbulent field. Such fiber formations processes include, for example, melt-spinning (i.e. spunbond), filament extrusion, electrospinning, gas jet fibrillation or combinations thereof.

The resulting webs have at least one dimension which decreases by no greater than 10% in the plane of the web when the web is heated to a temperature above a glass transition temperature of the fibers. The glass transition temperature of the fibers may be determined conventionally as is known in the art, for example, using differential scanning calorimetry (DSC), or modulated DSC. In certain exemplary embodiments, the thermoplastic polyester may be selected to include at least one aromatic polyester. In other exemplary embodiments, the aromatic polyester may be selected from PET, PETG, poly(butylene) terephthalate (PBT), poly(trimethyl) terephthalate (PTT), or combinations thereof.

As noted above, the fibers are preferably molecularly oriented; i.e., the fibers preferably comprise molecules that are aligned lengthwise of the fibers and are locked into (i.e., are thermally trapped into) that alignment. Oriented fibers are fibers where there is molecular orientation within the fiber. Fully oriented and partially oriented polymeric fibers are known and commercially available. Orientation of fibers can be measured in a number of ways, including birefringence, heat shrinkage, X-ray scattering, and elastic modulus (see e.g., *Principles of Polymer Processing*, Zehev Tadmor and Costas Gogos, John Wiley and Sons, New York, 1979, pp. 77-84). It is important to note that molecular orientation is distinct from crystallinity, as both crystalline and amorphous materials can exhibit molecular orientation independent from crystallization. Thus, even though commercially known sub-micrometer fibers made by melt-blowing or electrospinning are not oriented, there are known methods of imparting molecular orientation to fibers made using those processes.

Oriented fibers prepared according exemplary embodiments of the disclosure may show a difference in birefringence from segment to segment. By viewing a single fiber through a polarized microscope and estimating retardation number using the Michel-Levy chart (see, "On-Line Determination of Density and Crystallinity During Melt Spinning", Vishal Bansal et al, *Polymer Engineering and Science*, November 1996, Vol. 36, No. 2, pp. 2785-2798), birefringence is obtained with the following formula: birefringence=retardation (nm)/1000D, where D is the fiber diameter in micrometers. We have found that exemplary fibers susceptible to birefringence measurements generally include segments that differ in birefringence number by at least 5%, and preferably at least 10%. Some exemplary fibers may include segments that differ in birefringence number by 20 or even 50 percent. In some exemplary embodiments, the molecular orientation of the fibers results in a bi-refringence value of at least 0.00001, more preferably at least about 0.0001, still more preferably at least about 0.001, most preferably at least about 0.01.

Different oriented fibers or portions of an oriented fiber also may exhibit differences in properties as measured by differential scanning calorimetry (DSC). For example, DSC tests on exemplary webs prepared according to the disclosure may reveal the presence of chain-extended crystallization by the presence of a dual melting peak. A higher-temperature peak may be obtained for the melting point for a chain-extended, or strain-induced, crystalline portion; and another, generally lower-temperature peak may occur at the melting point for a non-chain-extended, or less-ordered, crystalline portion. The term "peak" herein means that portion of a heating curve that is attributable to a single process, e.g., melting of a specific molecular portion of a fiber such as a chain-extended portion. The peaks may be sufficiently close to one another that one peak has the appearance of a shoulder of the curve defining the other peak, but they are still regarded as separate peaks, because they represent melting points of distinct molecular fractions.

In certain exemplary embodiments, the passive longitudinal segments of the fibers may be oriented to a degree exhibited by typical spunbond fibrous webs. In crystalline or semi-crystalline polymers, such segments preferably exhibit strain-induced or chain-extended crystallization (i.e., molecular chains within the fiber have a crystalline order aligned generally along the fiber axis). As a whole, the web can exhibit strength properties like those obtained in spunbond webs, while being strongly bondable in ways that a typical spunbond web cannot be bonded. And autogeneously bonded webs of the invention can have a loft and uniformity through the web that are not available with the point-bonding or calendering generally used with spunbond webs.

While not intending to be bound by theory, it is believed that molecular orientation is improved through the use of fiber attenuation as is known in the art (See U. W. Gedde, *Polymer Physics,* 1st Ed. Chapman & Hall, London, 1995, 298). An increase in percent crystallinity of the attenuated fibers may thus be observed. The crystallites stabilize the filaments by acting as anchoring which inhibit chain motion, and rearrangement and crystallization of the rigid amorphous fraction; as the percentage of crystallinity is increased the rigid amorphous and amorphous fraction is decreased. Semi-crystalline, linear polymers consist of a crystalline and an amorphous phase with both phases being connected by tie molecules. The tie-molecule appears in both phases; strain builds at the coupled interface and it appears particularly obvious in the amorphous phase as observed in the broadening of the glass transition to higher temperatures in semi-crystalline polymers. In cases of strong coupling, the affected molecular segments are produce a separate intermediate phase of the amorphous phase called the rigid amorphous fraction. The intermediate phase, forming the extended boundary between the crystalline and amorphous phases, is characterized by lower local entropy than that of the fully amorphous phase.

At temperatures above the glass transition and below the melting temperature of the material, the rigid amorphous fraction rearranges and crystallizes; it undergoes cold crystallization. The percentages of crystalline and rigid amorphous material present in the fibers determine the macroscopic shrinkage value. The presence of crystallites may act to stabilize the filaments by acting as anchoring or tie points and inhibit chain motion.

Furthermore, it is presently believed that a total percent crystallinity of at least about 30% is required for PET to show dimensional stability at elevated temperatures; this level of crystallinity can generally only be obtained in a pure polyester system by thermally annealing the web after the fiber forming process. Additionally, in conventional melt spinning, 0.08 g/denier stress is generally required to induce crystallization in-line without any type of additive. In a typical spunbonding operation at production rates of 1 g/die hole/minute, spinning speeds of 6000 meters per minute are generally needed to produce the required thread-line tension. However, most spunbonding systems provide only filament speeds from 3,000-5,000 meters per minute (m/min).

Thus, exemplary embodiments of the present disclosure may be particularly useful in forming dimensionally stable nonwoven fibrous webs including molecularly oriented fibers using a high production rate spunbonding process. For example, dimensionally stable nonwoven fibrous webs of the present disclosure may, in some embodiments, be prepared using a spunbonding process at rates of at least 5,000 m/min, more preferably at least 6,000 m/min.

2. Non-molecularly Oriented Fibers

In alternative embodiments, dimensionally stable nonwoven fibrous webs can be prepared by fiber-forming processes in which substantially non-molecularly oriented filaments of fiber-forming material are formed from a mixture of one or more thermoplastic polyesters selected from aliphatic polyesters with polypropylene in an amount greater than 0% and no more than 10% by weight of the mixture, before or during extrusion. The resulting webs have at least one dimension which decreases by no greater than 10% in the plane of the web when the web is heated to a temperature above a glass transition temperature of the fibers. In some exemplary embodiments, the fibers may be formed using a melt-blowing (e.g. BMF) process.

3. Fiber Sizes

In some exemplary embodiments of the above referenced fiber-forming processes used to produce dimensionally stable nonwoven fibrous webs, a preferred fiber component is a fine fiber. In certain more preferred embodiments, a fine fiber component is a sub-micrometer fiber component comprising fibers having a median fiber diameter of no greater than one micrometer (μm). Thus, in certain exemplary embodiments, the fibers exhibit a median diameter of no greater than about one micrometer (μm). In some exemplary embodiments, the sub-micrometer fiber component comprises fibers have a median fiber diameter ranging from about 0.2 μm to about 0.9 μm. In other exemplary embodiments, the sub-micrometer fiber component comprises fibers have a median fiber diameter ranging from about 0.5 μm to about 0.7 μm.

The sub-micrometer fiber component may comprise monocomponent fibers comprising the above-mentioned polymers or copolymers (i.e., (co)polymers. In this exemplary embodiment, the monocomponent fibers may also contain additives as described below. Alternatively, the fibers formed may be multi-component fibers.

In other exemplary embodiments, the nonwoven fibrous webs of the present disclosure may additionally or alternatively comprise one or more coarse fiber components such as microfiber component. In some exemplary embodiments, the coarse fiber component may exhibit a median diameter of no greater than about 50 μm, more preferably no greater than 25 μm, more preferably no greater than 20 μm, even more preferably no greater than 15 μm, still more preferably no greater than 10 μm, and most preferably no greater than 5 μm. In other exemplary embodiments, a preferred coarse fiber component is a microfiber component comprising fibers having a median fiber diameter of at least 1 μm, more preferably at least 5 μm, more preferably still at least 10 μm, even more preferably at least 20 μm, and most preferably at least 25 μm. In certain exemplary embodiments, the microfiber component comprises fibers having a median fiber diameter ranging from about 1 μm to about 100 μm. In other exemplary embodiments, the microfiber component comprises fibers have a median fiber diameter ranging from about 5 μm to about 50 μm.

4. Layered Structures

In other exemplary embodiments, a multi-layer nonwoven fibrous web may be formed by overlaying on a support layer a dimensionally stable dimensionally stable nonwoven fibrous web comprising an overlayer of microfibers on an underlayer comprising a population of sub-micrometer fibers, such that at least a portion of the sub-micrometer fibers contact the support layer at a major surface of the single-layer nonwoven web. In such embodiments of a multi-layer nonwoven fibrous web, it will be understood that the term "overlayer" is intended to describe an embodiment wherein at least one layer overlays another layer in a multi-layer composite web. However, it will be understood that by flipping any multi-layer nonwoven fibrous web 180 degrees about a centerline, what has been described as an overlayer may become an underlayer, and the disclosure is intended to cover such modification to the illustrated embodiments. Furthermore, reference to "a layer" is intended to mean at least one layer, and therefore each illustrated embodiment of a multi-layer nonwoven fibrous web may include one or more additional layers (not shown) within the scope of the disclosure. In addition, reference to "a layer" is intended to describe a layer at least partially covering one or more additional layers (not shown).

For any of the previously described exemplary embodiments of a dimensionally stable nonwoven fibrous web according to the present disclosure, the web will exhibit a basis weight, which may be varied depending upon the particular end use of the web. Typically, the dimensionally stable nonwoven fibrous web has a basis weight of no greater than about 1000 grams per square meter (gsm). In some embodiments, the nonwoven fibrous web has a basis weight of from about 1.0 gsm to about 500 gsm. In other embodiments, the dimensionally stable nonwoven fibrous web has a basis weight of from about 10 gsm to about 300 gsm.

As with the basis weight, the nonwoven fibrous web will exhibit a thickness, which may be varied depending upon the particular end use of the web. Typically, the dimensionally stable nonwoven fibrous web has a thickness of no greater than about 300 millimeters (mm). In some embodiments, the dimensionally stable nonwoven fibrous web has a thickness of from about 0.5 mm to about 150 mm. In other embodiments, the dimensionally stable nonwoven fibrous web has a thickness of from about 1.0 mm to about 50 mm.

5. Optional Support Layer

The dimensionally stable nonwoven fibrous webs of the present disclosure may further comprise a support layer. When present, the support layer may provide most of the strength of the nonwoven fibrous article. In some embodiments, the above-described sub-micrometer fiber component tends to have very low strength, and can be damaged during normal handling. Attachment of the sub-micrometer fiber component to a support layer lends strength to the sub-micrometer fiber component, while retaining the low Solidity and hence the desired absorbent properties of the sub-micrometer fiber component. A multi-layer dimensionally stable nonwoven fibrous web structure may also provide sufficient strength for further processing, which may include, but is not limited to, winding the web into roll form, removing the web from a roll, molding, pleating, folding, stapling, weaving, and the like.

A variety of support layers may be used in the present disclosure. Suitable support layers include, but are not limited to, a nonwoven fabric, a woven fabric, a knitted fabric, a foam layer, a film, a paper layer, an adhesive-backed layer, a foil, a mesh, an elastic fabric (i.e., any of the above-described woven, knitted or nonwoven fabrics having elastic properties), an apertured web, an adhesive-backed layer, or any combination thereof. In one exemplary embodiment, the support layer comprises a polymeric nonwoven fabric. Suitable nonwoven polymeric fabrics include, but are not limited to, a spunbonded fabric, a meltblown fabric, a carded web of staple length fibers (i.e., fibers having a fiber length of no greater than about 100 mm), a needle-punched fabric, a split film web, a hydroentangled web, an airlaid staple fiber web, or a combination thereof. In certain exemplary embodiments, the support layer comprises a web of bonded staple fibers. As described further below, bonding may be effected using, for example, thermal bonding, adhesive bonding, powdered binder bonding, hydroentangling, needlepunching, calendering, or a combination thereof.

The support layer may have a basis weight and thickness depending upon the particular end use of the nonwoven fibrous article. In some embodiments of the present disclosure, it is desirable for the overall basis weight and/or thickness of the nonwoven fibrous article to be kept at a minimum level. In other embodiments, an overall minimum basis weight and/or thickness may be required for a given application. Typically, the support layer has a basis weight of no greater than about 150 grams per square meter (gsm). In some embodiments, the support layer has a basis weight of from about 5.0 gsm to about 100 gsm. In other embodiments, the support layer has a basis weight of from about 10 gsm to about 75 gsm.

As with the basis weight, the support layer may have a thickness, which varies depending upon the particular end use of the nonwoven fibrous article. Typically, the support layer has a thickness of no greater than about 150 millimeters (mm). In some embodiments, the support layer has a thickness of from about 1.0 mm to about 35 mm. In other embodiments, the support layer has a thickness of from about 2.0 mm to about 25 mm.

In certain exemplary embodiments, the support layer may comprise a microfiber component, for example, a plurality of microfibers. In such embodiments, it may be preferred to deposit the above-described sub-micrometer fiber population directly onto the microfiber support layer to form a multi-layer dimensionally stable nonwoven fibrous web. Optionally, the above-described microfiber population may deposited with or over the sub-micrometer fiber population on the microfiber support layer. In certain exemplary embodiments, the plurality of microfibers comprising the support layer is compositionally the same as the population of microfibers forming the overlayer.

The sub-micrometer fiber component may be permanently or temporarily bonded to a given support layer. In some embodiments of the present disclosure, the sub-micrometer fiber component is permanently bonded to the support layer (i.e., the sub-micrometer fiber component is attached to the support layer with the intention of being permanently bonded thereto).

In some embodiments of the present disclosure, the above-described sub-micrometer fiber component may be temporarily bonded to (i.e., removable from) a support layer, such as a release liner. In such embodiments, the sub-micrometer fiber component may be supported for a desired length of time on a temporary support layer, and optionally further processed on a temporary support layer, and subsequently permanently bonded to a second support layer.

In one exemplary embodiment of the present disclosure, the support layer comprises a spunbonded fabric comprising polypropylene fibers. In a further exemplary embodiment of the present disclosure, the support layer comprises a carded web of staple length fibers, wherein the staple length fibers comprise: (i) low-melting point or binder fibers; and (ii) high-melting point or structural fibers. Typically, the binder fibers have a melting point of at least 10° C. greater than a melting point of the structural fibers, although the difference between the melting point of the binder fibers and structural fibers may be greater than 10° C. Suitable binder fibers include, but are not limited to, any of the above-mentioned polymeric fibers. Suitable structural fibers include, but are not limited to, any of the above-mentioned polymeric fibers, as well as inorganic fibers such as ceramic fibers, glass fibers, and metal fibers; and organic fibers such as cellulosic fibers.

As described above, the support layer may comprise one or more layers in combination with one another. In one exemplary embodiment, the support layer comprises a first layer, such as a nonwoven fabric or a film, and an adhesive layer on the first layer opposite the sub-micrometer fiber component. In this embodiment, the adhesive layer may cover a portion of or the entire outer surface of the first layer. The adhesive may comprise any known adhesive including pressure-sensitive adhesives, heat activatable adhesives, etc. When the adhesive layer comprises a pressure-sensitive adhesive, the nonwoven fibrous article may further comprise a release liner to provide temporary protection of the pressure-sensitive adhesive.

6. Optional Additional Layers

The dimensionally stable nonwoven fibrous webs of the present disclosure may comprise additional layers in combination with the sub-micrometer fiber component, the support layer, or both. One or more additional layers may be present over or under an outer surface of the sub-micrometer fiber component, under an outer surface of the support layer, or both.

Suitable additional layers include, but are not limited to, a color-containing layer (e.g., a print layer); any of the above-described support layers; one or more additional sub-micrometer fiber components having a distinct median fiber diameter and/or physical composition; one or more secondary fine sub-micrometer fiber layers for additional insulation performance (such as a melt-blown web or a fiberglass fabric); foams; layers of particles; foil layers; films; decorative fabric layers; membranes (i.e., films with controlled permeability, such as dialysis membranes, reverse osmosis membranes, etc.); netting; mesh; wiring and tubing networks (i.e., layers of wires for conveying electricity or groups of tubes/pipes for conveying various fluids, such as wiring networks for heating blankets, and tubing networks for coolant flow through cooling blankets); or a combination thereof.

7. Optional Attachment Devices

In certain exemplary embodiments, the dimensionally stable nonwoven fibrous webs of the present disclosure may further comprise one or more attachment devices to enable the nonwoven fibrous article to be attached to a substrate. As discussed above, an adhesive may be used to attach the nonwoven fibrous article. In addition to adhesives, other attachment devices may be used. Suitable attachment devices include, but are not limited to, any mechanical fastener such as screws, nails, clips, staples, stitching, thread, hook and loop materials, etc.

The one or more attachment devices may be used to attach the nonwoven fibrous article to a variety of substrates. Exemplary substrates include, but are not limited to, a vehicle component; an interior of a vehicle (i.e., the passenger compartment, the motor compartment, the trunk, etc.); a wall of a building (i.e., interior wall surface or exterior wall surface); a ceiling of a building (i.e., interior ceiling surface or exterior ceiling surface); a building material for forming a wall or ceiling of a building (e.g., a ceiling tile, wood component, gypsum board, etc.); a room partition; a metal sheet; a glass substrate; a door; a window; a machinery component; an appliance component (i.e., interior appliance surface or exterior appliance surface); a surface of a pipe or hose; a computer or electronic component; a sound recording or reproduction device; a housing or case for an appliance, computer, etc.

B. Dimensionally Stable Nonwoven Fibrous Web Components

Various components of exemplary dimensionally stable nonwoven fibrous webs according to the present disclosure will now be described. In some exemplary embodiments, the dimensionally stable nonwoven fibrous webs may include a plurality of continuous fibers comprising one or more thermoplastic polyesters selected from aliphatic polyesters and aromatic polyesters; and polypropylene in an amount greater than 0% and no more than 10% by weight of the web, wherein the fibers exhibit molecular orientation and extend substantially endlessly through the web, and further wherein the web has at least one dimension which decreases by no greater than 10% in the plane of the web when the web is heated to a temperature above a glass transition temperature of the fibers. Such dimensionally stable nonwoven fibrous webs may be produced, in certain exemplary embodiments, using a spunbond or melt spinning process.

In other exemplary embodiments, the dimensionally stable nonwoven fibrous webs may include a plurality of fibers comprising one or more thermoplastic polyesters selected from aliphatic polyesters; and polypropylene in an amount greater than 0% and no more than 10% by weight of the web, wherein the fibers do not exhibit molecular orientation, and further wherein the web has at least one dimension in the plane of the web which decreases by no greater than 10% in the plane of the web when the web is heated to a temperature above a glass transition temperature of the fibers. Such dimensionally stable nonwoven fibrous webs may be produced, in certain exemplary embodiments, using a meltblown or BMF process.

1. Thermoplastic Polyesters

The fibrous webs of the present disclosure include at least one thermoplastic polyester. In some exemplary embodiments an aromatic polyester is used as a major component in the fiber-forming mixture. In certain exemplary embodiments, the aromatic polyester is selected poly(ethylene) terephthalate (PET), poly(ethylene) terephthalate glycol (PETG), poly(butylene) terephthalate (PBT), poly(trimethyl) terephthalate (PTT), their copolymers, and combinations thereof.

In other exemplary embodiments, an aliphatic polyester is used as a major component in the fiber-forming mixture. Aliphatic polyesters useful in practicing embodiments of the present invention include homo- and copolymers of poly (hydroxyalkanoates) and homo- and copolymers of those aliphatic polyesters derived from the reaction product of one or more polyols with one or more polycarboxylic acids that is typically formed from the reaction product of one or more alkanediols with one or more alkanedicarboxylic acids (or acyl derivatives). Polyesters may further be derived from multifunctional polyols, e.g. glycerin, sorbitol, pentaerythritol, and combinations thereof, to form branched, star, and graft homo- and copolymers. Miscible and immiscible blends of aliphatic polyesters with one or more additional semicrystalline or amorphous polymers may also be used.

Exemplary aliphatic polyesters are poly(lactic acid), poly (glycolic acid), poly(lactic-co-glycolic acid), polybutylene succinate, polyhydroxybutyrate, polyhydroxyvalerate, blends, and copolymers thereof. One particularly useful class of aliphatic polyesters are poly(hydroxyalkanoates), derived by condensation or ring-opening polymerization of hydroxy acids, or derivatives thereof. Suitable poly(hydroxyalkanoates) may be represented by the formula:

$$H(O—R—C(O)—)_nOH,$$

where R is an alkylene moiety that may be linear or branched having 1 to 20 carbon atoms, preferably 1 to 12 carbon atoms optionally substituted by catenary (bonded to carbon atoms in a carbon chain) oxygen atoms; n is a number such that the ester is polymeric, and is preferably a number such that the molecular weight of the aliphatic polyester is at least 10,000, preferably at least 30,000, and most preferably at least 50,000 daltons. Although higher molecular weight polymers generally yield films with better mechanical properties, for both melt processed and solvent cast polymers excessive viscosity is undesirable. The molecular weight of the aliphatic polyester is typically no greater than 1,000,000, preferably no greater than 500,000, and most preferably no greater than 300,000 daltons. R may further comprise one or more caternary (i.e., in chain) ether oxygen atoms. Generally, the R group of the hydroxy acid is such that the pendant hydroxyl group is a primary or secondary hydroxyl group.

Useful poly(hydroxyalkanoates) include, for example, homo- and copolymers of poly(3-hydroxybutyrate), poly(4-hydroxybutyrate), poly(3-hydroxyvalerate), poly(lactic acid) (as known as polylactide), poly(3-hydroxypropanoate), poly(4-hydropentanoate), poly(3-hydroxypentanoate), poly(3-hydroxyhexanoate), poly(3-hydroxyheptanoate), poly(3-hydroxyoctanoate), polydioxanone, polycaprolactone, and polyglycolic acid (i.e., polyglycolide). Copolymers of two or more of the above hydroxy acids may also be used, for example, poly(3-hydroxybutyrate-co-3-hydroxyvalerate), poly(lactate-co-3-hydroxypropanoate), poly(glycolide-co-p-dioxanone), and poly(lactic acid-co-glycolic acid). Blends of two or more of the poly(hydroxyalkanoates) may also be used, as well as blends with one or more polymers and/or copolymers.

The aliphatic polyester may be a block copolymer of poly(lactic acid-co-glycolic acid). Aliphatic polyesters useful in the inventive fine fibers may include homopolymers, random copolymers, block copolymers, star-branched random copolymers, star-branched block copolymers, dendritic copolymers, hyperbranched copolymers, graft copolymers, and combinations thereof.

Another useful class of aliphatic polyesters includes those aliphatic polyesters derived from the reaction product of one or more alkanediols with one or more alkanedicarboxylic acids (or acyl derivatives). Such polyesters have the general formula:

$$HO(\overset{O}{\overset{\|}{C}}R''\overset{O}{\overset{\|}{C}})_n—[OR'O—\overset{O}{\overset{\|}{C}}—R''—\overset{O}{\overset{\|}{C}}—O]_m\bullet(R'O)_nH,$$

where R' and R" each represent an alkylene moiety that may be linear or branched having from 1 to 20 carbon atoms, preferably 1 to 12 carbon atoms, and m is a number such that the ester is polymeric, and is preferably a number such that the molecular weight of the aliphatic polyester is at least 10,000, preferably at least 30,000, and most preferably at least 50,000 daltons, but no greater than 1,000,000, preferably no greater than 500,000 and most preferably no greater than 300,000 daltons. Each n is independently 0 or 1. R' and R" may further comprise one or more caternary (i.e. in chain) ether oxygen atoms.

Examples of aliphatic polyesters include those homo- and copolymers derived from (a) one or more of the following diacids (or derivative thereof): succinic acid; adipic acid; 1,12 dicarboxydodecane; fumaric acid; glutaric acid; diglycolic acid; and maleic acid; and (b) one of more of the following diols: ethylene glycol; polyethylene glycol; 1,2-propane diol; 1,3-propanediol; 1,2-propanediol; 1,2-butanediol; 1,3-butanediol; 1,4-butanediol; 2,3-butanediol; 1,6-hexanediol; 1,2 alkane diols having 5 to 12 carbon atoms; diethylene glycol; polyethylene glycols having a molecular weight of 300 to 10,000 daltons, preferably 400 to 8,000 daltons; propylene glycols having a molecular weight of 300 to 4000 daltons; block or random copolymers derived from ethylene oxide, propylene oxide, or butylene oxide; dipropylene glycol; and polypropylene glycol, and (c) optionally a small amount, i.e., 0.5-7.0-mole % of a polyol with a functionality greater than two such as glycerol, neopentyl glycol, and pentaerythritol.

Such polymers may include polybutylenesuccinate homopolymer, polybutylene adipate homopolymer, polybutyleneadipate-succinate copolymer, polyethylenesuccinate-adipate copolymer, polyethylene glycol succinate homopolymer and polyethylene adipate homopolymer.

Commercially available aliphatic polyesters include poly (lactide), poly(glycolide), poly(lactide-co-glycolide), poly (L-lactide-co-trimethylene carbonate), poly(dioxanone), poly(butylene succinate), and poly(butylene adipate).

Useful aliphatic polyesters include those derived from semicrystalline polylactic acid. Poly(lactic acid) or polylactide has lactic acid as its principle degradation product, which is commonly found in nature, is non-toxic and is widely used in the food, pharmaceutical and medical industries. The polymer may be prepared by ring-opening polymerization of the lactic acid dimer, lactide. Lactic acid is optically active and the dimer appears in four different forms: L,L-lactide, D,D-lactide, D,L-lactide (meso lactide) and a racemic mixture of L,L- and D,D-. By polymerizing these lactides as pure compounds or as blends, poly(lactide) polymers may be obtained having different stereochemistries and different physical properties, including crystallinity. The L,L- or D,D-lactide yields semicrystalline poly (lactide), while the poly(lactide) derived from the D,L-lactide is amorphous.

The polylactide preferably has a high enantiomeric ratio to maximize the intrinsic crystallinity of the polymer. The degree of crystallinity of a poly(lactic acid) is based on the regularity of the polymer backbone and the ability to crystallize with other polymer chains. If relatively small amounts of one enantiomer (such as D-) is copolymerized with the opposite enantiomer (such as L-) the polymer chain becomes irregularly shaped, and becomes less crystalline. For these reasons, when crystallinity is favored, it is desirable to have a poly(lactic acid) that is at least 85% of one isomer, at least 90% of one isomer, or at least 95% of one isomer in order to maximize the crystallinity.

An approximately equimolar blend of D-polylactide and L-polylactide is also useful. This blend forms a unique crystal structure having a higher melting point (~210° C.) than does either the D-poly(lactide) and L-(polylactide) alone (~160° C.), and has improved thermal stability, see H. Tsuji et. al., *Polymer,* 40 (1999) 6699-6708.

Copolymers, including block and random copolymers, of poly(lactic acid) with other aliphatic polyesters may also be used. Useful co-monomers include glycolide, beta-propiolactone, tetramethylglycolide, beta-butyrolactone, gamma-butyrolactone, pivalolactone, 2-hydroxybutyric acid, alpha-hydroxyisobutyric acid, alpha-hydroxyvaleric acid, alpha-hydroxyisovaleric acid, alpha-hydroxycaproic acid, alpha-hydroxyethylbutyric acid, alpha-hydroxyisocaproic acid, alpha-hydroxy-beta-methylvaleric acid, alpha-hydroxyoctanoic acid, alpha-hydroxydecanoic acid, alpha-hydroxymyristic acid, and alpha-hydroxystearic acid.

Blends of poly(lactic acid) and one or more other aliphatic polyesters, or one or more other polymers may also be used. Examples of useful blends include poly(lactic acid) and poly(vinyl alcohol), polyethylene glycol/polysuccinate, polyethylene oxide, polycaprolactone and polyglycolide.

Poly(lactide)s may be prepared as described in U.S. Pat. Nos. 6,111,060 (Gruber, et al.), U.S. Pat. No. 5,997,568 (Liu), U.S. Pat. No. 4,744,365 (Kaplan et al.), U.S. Pat. No. 5,475,063 (Kaplan et al.), U.S. Pat. No. 6,143,863 (Gruber et al.), U.S. Pat. No. 6,093,792 (Gross et al.), U.S. Pat. No. 6,075,118 (Wang et al.), U.S. Pat. No. 5,952,433 (Wang et al.), U.S. Pat. No. 6,117,928 (Hiltunen et al.), and U.S. Pat. No. 5,883,199 (McCarthy et al.), WO 98/24951 (Tsai et al.), WO 00/12606 (Tsai et al.), WO 84/04311 (Lin), WO 99/50345 (Kolstad et al.), WO 99/06456 (Wang et al.), WO 94/07949 (Gruber et al.), WO 96/22330 (Randall et al.), and WO 98/50611 (Ryan et al.). Reference may also be made to J. W. Leenslag, et al., *J. Appl. Polymer Science, vol.* 29 (1984), pp 2829-2842, and H.R. Kricheldorf, *Chemosphere*, vol. 43, (2001) 49-54.

The molecular weight of the polymer should be chosen so that the polymer may be processed as a melt. For polylactide, for example, the molecular weight may be from about 10,000 to 1,000,000 daltons, and is preferably from about 30,000 to 300,000 daltons. By "melt-processable", it is meant that the aliphatic polyesters are fluid or can be pumped or extruded at the temperatures used to process the articles (e.g. make the fine fibers in BMF), and do not degrade or gel at those temperatures to the extent that the physical properties are so poor as to be unusable for the intended application. Thus, many of the materials can be made into nonwovens using melt processes such as spunbond, blown microfiber, and the like. Certain embodiments also may be injection molded. The aliphatic polyester may be blended with other polymers but typically comprises at least 50 weight percent, preferably at least 60 weight percent, and most preferably at least 65 weight percent of the fine fibers.

2. Polypropylenes

Polypropylene (homo)polymers and copolymers useful in practicing embodiments of the present disclosure may be selected from polypropylene homopolymers, polypropylene copolymers, and blends thereof (collectively polypropylene (co)polymers). The homopolymers may be atactic polypropylene, isotactic polypropylene, syndiotactic polypropylene and blends thereof. The copolymer can be a random copolymer, a statistical copolymer, a block copolymer, and blends thereof. In particular, the inventive polymer blends described herein include impact (co)polymers, elastomers and plastomers, any of which may be physical blends or in situ blends with the polypropylene.

The method of making the polypropylene (co)polymer is not critical, as it can be made by slurry, solution, gas phase or other suitable processes, and by using catalyst systems appropriate for the polymerization of polyolefins, such as Ziegler-Natta-type catalysts, metallocene-type catalysts, other appropriate catalyst systems or combinations thereof. In a preferred embodiment the propylene (co)polymers are made by the catalysts, activators and processes described in U.S. Pat. Nos. 6,342,566; 6,384,142; and 5,741,563; and WO 03/040201; WO 97/19991. Likewise, (co)polymers may be prepared by the process described in U.S. Pat. Nos. 6,342,566 and 6,384,142. Such catalysts are well known in the art, and are described in, for example, ZIEGLER CATALYSTS (Gerhard Fink, Rolf Mulhaupt and Hans H. Brintzinger, eds., Springer-Verlag 1995); Resconi et al., Selectivity in Propene Polymerization with Metallocene Catalysts, 100 CHEM. REV. 1253-1345 (2000); and I, II METALLOCENE-BASED POLYOLEFINS (Wiley & Sons 2000).

Propylene (co)polymers that are useful in practicing some embodiments of the presently disclosed invention include those sold under the tradenames ACHIEVE and ESCORENE by Exxon-Mobil Chemical Company (Houston, Tex.), and various propylene (co)polymers sold by Total Petrochemicals (Houston, Tex.).

Presently preferred propylene homopolymers and copolymers useful in this invention typically have: 1) a weight average molecular weight (Mw) of at least 30,000 Da, preferably at least 50,000 Da, more preferably at least 90,000 Da, as measured by gel permeation chromatography (GPC), and/or no more than 2,000,000 Da, preferably no more than 1,000,000 Da, more preferably no more than 500,000 Da, as measured by gel permeation chromatography (GPC); and/or 2) a polydispersity (defined as Mw/Mn, wherein Mn is the number average molecular weight determined by GPC) of 1, preferably 1.6, and more preferably 1.8, and/or no more than 40, preferably no more than 20, more preferably no more than 10, and even more preferably no more than 3; and/or 3) a melting temperature Tm (second melt) of at least 30° C., preferably at least 50° C., and more preferably at least 60° C. as measured by using differential scanning calorimetry (DSC), and/or no more than 200° C., preferably no more than 185° C., more preferably no more than 175° C., and even more preferably no more than 170° C. as measured by using differential scanning calorimetry (DSC); and/or 4) a crystallinity of at least 5%, preferably at least 10%, more preferably at least 20% as measured using DSC, and/or no more than 80%, preferably no more than 70%, more preferably no more than 60% as measured using DSC; and/or 5) a glass transition temperature ($T_g$) of at least −40° C., preferably at least −10° C., more preferably at least −10° C., as measured by dynamic mechanical thermal analysis (DMTA), and/or no more than 20° C., preferably no more than 10° C., more preferably no more than 5° C., as measured by dynamic mechanical thermal analysis (DMTA); and/or 6) a heat of fusion ($H_f$) of 180 J/g or less, preferably 150 J/g or less, more preferably 120 J/g or less as measured by DSC and/or at least 20 J/g, more preferably at least 40 J/g as measured by DSC; and/or 7) a crystallization temperature (Tc) of at least 15° C., preferably at least 20° C., more preferably at least 25° C., even more preferably at least 60° C. and/or, no more than 120° C., preferably no more than 115° C., more preferably no more than 110° C., even more preferably no more than 145° C.

Exemplary webs of the present disclosure may include propylene (co)polymers (including both poly(propylene) homopolymers and copolymers) in an amount of at least 1% by weight of the web, more preferably at least about 2% by weight of the web, most preferably at least 3% by weight of the web. Other exemplary webs may include propylene (co)polymers (including both poly(propylene) homopolymers and copolymers) in an amount no more than 10% by weight of the web, more preferably in an amount no more than 8% by weight of the web, most preferably in an amount no more than 6% by weight of the web. In certain presently preferred embodiments, the webs comprise polypropylene from about 1% to about 6% by weight of the web, more preferably from about 3% to no more than 5% by weight of the web.

3. Optional Additives

Fibers also may be formed from blends of materials, including materials into which certain additives have been blended, such as pigments or dyes. In addition to the fiber-forming materials mentioned above, various additives may be added to the fiber melt and extruded to incorporate the additive into the fiber. Typically, the amount of additives is no greater than about 25 wt %, desirably, up to about 5.0 wt %, based on a total weight of the fiber. Suitable additives include, but are not limited to, particulates, fillers, stabilizers, plasticizers, tackifiers, flow control agents, cure rate retarders, adhesion promoters (for example, silanes and titanates), adjuvants, impact modifiers, expandable microspheres, thermally conductive particles, electrically conductive particles, silica, glass, clay, talc, pigments, colorants, glass beads or bubbles, antioxidants, optical brighteners, antimicrobial agents, surfactants, wetting agents, fire retardants, and repellents such as hydrocarbon waxes, silicones, and fluorochemicals.

One or more of the above-described additives may be used to reduce the weight and/or cost of the resulting fiber and layer, adjust viscosity, or modify the thermal properties of the fiber or confer a range of physical properties derived from the physical property activity of the additive including electrical, optical, density-related, liquid barrier or adhesive tack related properties.

i) Plasticizers

In some exemplary embodiments, a plasticizer for the thermoplastic polyester may be used in forming the fine fibers. In some exemplary embodiments, the plasticizer for the thermoplastic polyester is selected from poly(ethylene glycol), oligomeric polyesters, fatty acid monoesters and di-esters, citrate esters, or combinations thereof. Suitable plasticizers that may be used with the aliphatic polyesters include, for example, glycols such glycerin; propylene glycol, polyethoxylated phenols, mono or polysubstituted polyethylene glycols, higher alkyl substituted N-alkyl pyrrolidones, sulfonamides, triglycerides, citrate esters, esters of tartaric acid, benzoate esters, polyethylene glycols and ethylene oxide propylene oxide random and block copolymers having a molecular weight no greater than 10,000 Daltons (Da), preferably no greater than about 5,000 Da, more preferably no greater than about 2,500 Da; and combinations thereof.

ii) Diluent

In some exemplary embodiments, a diluent may be added to the mixture used to form the fine fibers. In certain exemplary embodiments, the diluent may be selected from a fatty acid monoester (FAME), a PLA oligomer, or combinations thereof. Diluent as used herein generally refers to a material that inhibits, delays, or otherwise affects crystallinity as compared to the crystallinity that would occur in the absence of the diluent. Diluents may also function as plasticizers.

iii) Surfactants

In certain exemplary embodiments, it may be desirable to add a surfactant to the mixture used to form the fine fibers. In particular exemplary embodiments, the surfactant may be selected from a nonionic surfactant, an anionic surfactant, a cationic surfactant, a zwitterionic surfactant, or combinations thereof. In additional exemplary embodiments, the surfactant may be selected from a fluoro-organic surfactant, a silicone-functional surfactant, an organic wax, or a salt of anionic surfactants such as dioctylsulfosuccinate.

In one presently preferred embodiment, the fine fibers may comprise anionic surfactants that impart durable hydrophilicity. Examples of anionic surfactants suitable for use in the present invention include those described in U.S. Patent Application Publication No. US 2008/0200890 A1; and U.S. Ser. No. 61/061,088, filed Jun. 12, 2008.

iv) Viscosity Modifiers

In some exemplary embodiments, fine fibers comprising a thermoplastic aliphatic polyester polymer, e.g., polylactic acid, polyhydroxybutyrate and the like, greater than 0% but 10% or less by weight of polypropylene, and one or more viscosity modifiers selected from the group of alkyl, alkenyl, aralkyl, or alkaryl carboxylates, or combinations thereof, are formed using a fiber forming process.

The fine fibers disclosed herein may include one or more viscosity modifier(s) to reduce the average diameter of the fiber during the melt process (e.g. blown microfiber (BMF), spunbond, or injection molding). By reducing the viscosity of the aliphatic polyester during the BMF process, the average diameter of the fibers may be reduced, resulting in fine fibers, typically no greater than 20 micrometers, in the melt blown web.

We have found that the addition of traditional plasticizers for the aliphatic polyester thermoplastics result in a very gradual viscosity reduction. This is generally not useful for producing fine fibers of sufficient mechanical strength since the plasticizers degrade polymer strength.

Viscosity reduction can be detected in the extrusion/BMF equipment by recording the pressures within the equipment. The viscosity modifiers of the present invention result in a dramatic viscosity reduction and thus back pressure during extrusion or thermal processing. In many cases, the viscosity reduction is so great that the melt processing temperature must be reduced in order to maintain sufficient melt strength. Often the melt temperature is reduced 30° C. or more.

In applications in which biodegradability is important, it may be desirable to incorporate biodegradable viscosity modifiers, which typically include ester and/or amide groups that may be hydrolytically or enzymatically cleaved. Exemplary viscosity modifiers useful in the fine fibers described herein include viscosity modifiers with the following structure:

$$R—CO_2^-M^+$$

where R is alkyl or alkylene of C8-C30 which is branched or straight chain or C12-C30 aralkyl and may be optionally substituted with 0-100 alkylene oxide groups such as ethylene oxide, propylene oxide groups, oligomeric lactic and/or glycolic acid or a combination thereof; and M is H, an alkali metals or an alkaline earth metal salt, preferably Na+, K+, or Ca++, or amine salts including tertiary and quaternary amines such as protonated triethanolamine, tetramethylammonium and the like.

In the formula above, the ethylene oxide groups and propylene oxide groups can occur in reverse order as well as in a random, sequential, or block arrangement.

In certain preferred embodiments, the viscosity modifiers useful to form fine fibers are selected from the group consisting of alkyl carboxylates, alkenyl carboxylates, aralkyl carboxylates, alkylethoxylated carboxylates, aralkylethoxylated carboxylates, alkyl lactylates, alkenyl lactylates, and mixtures thereof. The carboxylic acid equivalents of the carboxylates may also function as viscosity modifiers. Combinations of various viscosity modifiers can also be used. As used herein a lactylate is a surfactant having a hydrophobe and a hydrophile wherein the hydrophile is at least in part an oligomer of lactic acid having 1-5 lactic acid units and typically having 1-3 lactic acid units. A preferred lactylate is calcium stearoyl lactylate from Rita Corp. which is reported to have the following structure: $[CH_3(CH_2)_{16}C(O)O—CH(CH_3)—C(O)O—CH(CH3)-C(O)O^-]_2\ Ca^{++}$. Alkyl lactylates are a preferred class of viscosity modifiers since these also are made from resource renewable materials.

The viscosity modifiers typically melt at or below the extrusion temperature of the thermoplastic aliphatic polyester composition. This greatly facilitates dispersing or dissolving the viscosity modifier in the polymer composition. Mixtures of viscosity modifiers may be employed to modify the melting point. For example, mixtures of alkyl carboxylates may be preformed or an alkyl carboxylate may be blended with a nonionic surfactant such as a polyethoxylated surfactant. The necessary processing temperature may be altered by addition of nonsurfactant components as well such as plasticizers for the thermoplastics aliphatic polyester. For example, when added to polylactic acid compositions, the viscosity modifiers preferably have a melting point of no greater than 200° C., preferably no greater than 180° C., more preferably no greater than 170° C., and even more preferably no greater than 160° C.

The viscosity modifier can be conveniently compounded with the resin in the hopper or elsewhere along the extruder as long as good mixing is achieved to render a substantially uniform mixture. Alternatively, the viscosity modifier may be added into the extruder directly (without pre-compounding), for example, using a positive displacement pump or weight loss feeder.

In some embodiments, when used in the fine fibers, the viscosity modifiers are present in a total amount of at least 0.25 wt. %, at least 0.5 wt. %, at least 1.0 wt. %, or at least 2.0 wt. %, based on the total weight of the fine fibers. In certain embodiments, in which a very low viscosity melt is desired and/or a low melt temperature is preferred, the fine fibers comprise greater than 2 wt. %, greater than 3 wt. %, or even greater than 5 wt. % of the viscosity modifier based on the weight of the aliphatic polyester polymer in the fine fibers.

For melt processing, preferred viscosity modifiers have low volatility and do not decompose appreciably under process conditions. The preferred viscosity modifiers contain no greater than 10 wt. % water, preferably no greater than 5% water, and more preferably no greater than 2 wt. % and even more preferably no greater than 1% water (determined by Karl Fischer analysis). Moisture content is kept low in order to prevent hydrolysis of the aliphatic polyester or other hydrolytically sensitive compounds in the fine fibers.

The viscosity modifiers may be carried in a nonvolatile carrier. Importantly, the carrier is typically thermally stable and can resist chemical breakdown at processing temperatures which may be as high as 150° C., 200° C., 250° C., or even as high as 300° C. Preferred carriers for hydrophilic articles include polyalkylene oxides such as polyethylene glycol, polypropylene glycol, random and block copolymers of ethylene oxide and propylene oxide, thermally stable polyhydric alcohols such as propylene glycol, glycerin, polyglycerin, and the like. The polyalkylene oxides/polyalkylene glycols may be linear or branched depending on the initiating polyol. For example, a polyethylene glycol initiated using ethylene glycol would be linear but one initiated with glycerin, trimethylolpropane, or pentaerythritol would be branched.

The viscosity modifier may be present in the melt extruded fiber in an amount sufficient to modify the melt viscosity of aliphatic polyester. Typically, the viscosity modifier is present at no greater than 10 weight %, preferably no greater than 8 weight %, more preferably no greater than 7%, more preferably no greater than 6 weight %, more preferably no greater than 3 weight %, and most preferably no greater than 2% by weight based on the combined weight of the aliphatic polyester and viscosity modifier.

v) Antimicrobials

An antimicrobial component may be added to impart antimicrobial activity to the fine fibers. The antimicrobial component is the component that provides at least part of the antimicrobial activity, i.e., it has at least some antimicrobial activity for at least one microorganism. It is preferably present in a large enough quantity to be released from the fine fibers and kill bacteria. It may also be biodegradable and/or made or derived from renewable resources such as plants or plant products. Biodegradable antimicrobial components can include at least one functional linkage such as an ester or amide linkage that can be hydrolytically or enzymatically degraded.

In some exemplary embodiments, a suitable antimicrobial component may be selected from a fatty acid monoester, a fatty acid di-ester, an organic acid, a silver compound, a quaternary ammonium compound, a cationic (co)polymer, an iodine compound, or combinations thereof. Other examples of antimicrobial components suitable for use in the present invention include those described in U.S. Patent Application Publication No. 2008/0142023.

Certain antimicrobial components are uncharged and have an alkyl or alkenyl hydrocarbon chain containing at least 7 carbon atoms. For melt processing, preferred antimicrobial components have low volatility and do not decompose under process conditions. The preferred antimicrobial components contain no greater than 2 wt. % water, and more preferably no greater than 0.10 wt. % (determined by Karl Fischer analysis). Moisture content is kept low in order to prevent hydrolysis of the aliphatic polyester during extrusion.

When used, the antimicrobial component content (as it is ready to use) is typically at least 1 wt. %, 2 wt. %, 5 wt. %, 10 wt. % and sometimes greater than 15 wt. %. In certain embodiments, in which a low strength is desired, the antimicrobial component comprises greater than 20 wt. %, greater than 25 wt. %, or even greater than 30 wt. % of the fine fibers.

Certain antimicrobial components are amphiphiles and may be surface active. For example, certain antimicrobial alkyl monoglycerides are surface active. For certain embodiments of the invention that include antimicrobial components, the antimicrobial component is considered distinct from a viscosity modifier component.

vi) Particulate Phase

The fine fibers may further comprise organic and inorganic fillers present as either an internal particulate phase within the fibers, or as an external particulate phase on or near the surface of the fine fibers. For implantable applications biodegradable, resorbable, or bioerodible inorganic fillers may be particularly appealing. These materials may help to control the degradation rate of the polymer fine fibers. For example, many calcium salts and phosphate salts may be suitable. Exemplary biocompatible resorbable fillers include calcium carbonate, calcium sulfate, calcium phosphate, calcium sodium phosphates, calcium potassium phosphates, tetra-calcium phosphate, alpha-tri-calcium phosphate, beta-tri-calcium phosphate, calcium phosphate apatite, octa-calcium phosphate, di-calcium phosphate, calcium carbonate, calcium oxide, calcium hydroxide, calcium sulfate di-hydrate, calcium sulfate hemihydrate, calcium fluoride, calcium citrate, magnesium oxide, and magnesium hydroxide. A particularly suitable filler is tri-basic calcium phosphate (hydroxy apatite).

Other additional components include antioxidants, colorants such as dyes and/or pigments, antistatic agents, fluorescent brightening agents, odor control agents, perfumes and fragrances, active ingredients to promote wound healing or other dermatological activity, combinations thereof, and the like.

C. Methods of Making Dimensionally Stable Nonwoven Fibrous Webs

Exemplary processes that are capable of producing oriented fine fibers include: oriented film filament formation, melt-spinning, plexifilament formation, spunbonding, wet spinning, and dry spinning Suitable processes for producing oriented fibers are also known in the art (see, for example, Ziabicki, Andrzej, *Fundamentals of Fibre Formation: The Science of Fibre Spinning and Drawing*, Wiley, London, 1976.). Orientation does not need to be imparted within a fiber during initial fiber formation, and may be imparted after fiber formation, most commonly using drawing or stretching processes.

The dimensionally stable nonwoven fibrous webs may include fine fibers that are substantially sub-micrometer fibers, fine fibers that are substantially microfibers, or combinations thereof. In some exemplary embodiments, a dimensionally stable nonwoven fibrous web may be formed of sub-micrometer fibers commingled with coarser microfibers providing a support structure for the sub-micrometer nonwoven fibers. The support structure may provide the resiliency and strength to hold the fine sub-micrometer fibers in the preferred low Solidity form. The support structure could be made from a number of different components, either singly or in concert. Examples of supporting components include, for example, microfibers, discontinuous oriented fibers, natural fibers, foamed porous cellular materials, and continuous or discontinuous non oriented fibers.

Sub-micrometer fibers are typically very long, though they are generally regarded as discontinuous. Their long lengths—with a length-to-diameter ratio approaching infinity in contrast to the finite lengths of staple fibers—causes them to be better held within the matrix of microfibers. They are usually organic and polymeric and often of the molecularly same polymer as the microfibers. As the streams of sub-micrometer fiber and microfibers merge, the sub-micrometer fibers become dispersed among the microfibers. A rather uniform mixture may be obtained, especially in the x-y dimensions, or plane of the web, with the distribution in the z dimension being controlled by particular process steps such as control of the distance, the angle, and the mass and velocity of the merging streams.

The relative amount of sub-micrometer fibers to microfibers included in a blended nonwoven composite fibrous web of the present disclosure can be varied depending on the intended use of the web. An effective amount, i.e., an amount effective to accomplish desired performance, need not be large in weight amount. Usually the microfibers account for at least one weight percent and no greater than about 75 weight percent of the fibers of the web. Because of the high surface area of the microfibers, a small weight amount may accomplish desired performance. In the case of webs that include very small microfibers, the microfibers generally account for at least 5 percent of the fibrous surface area of the web, and more typically 10 or 20 percent or more of the fibrous surface area. A particular advantage of exemplary embodiments of the present invention is the ability to present small-diameter fibers to a needed application such as filtration or thermal or acoustic insulation.

In one exemplary embodiment, a microfiber stream is formed and a sub-micrometer fiber stream is separately formed and added to the microfiber stream to form the dimensionally stable nonwoven fibrous web. In another exemplary embodiment, a sub-micrometer fiber stream is formed and a microfiber stream is separately formed and added to the sub-micrometer fiber stream to form the dimensionally stable nonwoven fibrous web. In these exemplary embodiments, either one or both of the sub-micrometer fiber stream and the microfiber stream is oriented. In an additional embodiment, an oriented sub-micrometer fiber stream is formed and discontinuous microfibers are added to the sub-micrometer fiber stream, e.g. using a process as described in U.S. Pat. No. 4,118,531 (Hauser).

In some exemplary embodiments, the method of making a dimensionally stable nonwoven fibrous web comprises combining the sub-micrometer fiber population and the microfiber population into a dimensionally stable nonwoven fibrous web by mixing fiber streams, hydroentangling, wet forming, plexifilament formation, or a combination thereof. In combining the sub-micrometer fiber population with the microfiber population, multiple streams of one or both types of fibers may be used, and the streams may be combined in any order. In this manner, nonwoven composite fibrous webs may be formed exhibiting various desired concentration gradients and/or layered structures.

For example, in certain exemplary embodiments, the population of sub-micrometer fibers may be combined with the population of microfibers to form an inhomogenous mixture of fibers. In other exemplary embodiments, the population of sub-micrometer fibers may be formed as an overlayer on an underlayer comprising the population of microfibers. In certain other exemplary embodiments, the population of microfibers may be formed as an overlayer on an underlayer comprising the population of sub-micrometer fibers.

In other exemplary embodiments, the nonwoven fibrous article may be formed by depositing the population of sub-micrometer fibers onto a support layer, the support layer optionally comprising microfibers, so as to form a population of sub-micrometer fibers on the support layer or substrate. The method may comprise a step wherein the support layer, which optionally comprises polymeric microfibers, is passed through a fiber stream of sub-micrometer fibers having a median fiber diameter of no greater than 1 micrometer (μm). While passing through the fiber stream, sub-micrometer fibers may be deposited onto the support layer so as to be temporarily or permanently bonded to the support layer. When the fibers are deposited onto the support layer, the fibers may optionally bond to one another, and may further harden while on the support layer.

In certain presently preferred embodiments, the sub-micrometer fiber population is combined with an optional support layer that comprises at least a portion of the microfiber population. In other presently preferred embodiments, the sub-micrometer fiber population is combined with an optional support layer and subsequently combined with at least a portion of the microfiber population.

1. Formation of Sub-micrometer Fibers

A number of processes may be used to produce and deposit sub-micrometer fibers, including, but not limited to melt blowing, melt spinning, or combination thereof. Particularly suitable processes include, but are not limited to, processes disclosed in U.S. Pat. Nos. 3,874,886 (Levecque et al.), U.S. Pat. No. 4,363,646 (Torobin), U.S. Pat. No. 4,536,361 (Torobin), U.S. Pat. No. 5,227,107 (Dickenson et al.), U.S. Pat. No. 6,183,670 (Torobin), U.S. Pat. No. 6,743,273 (Chung et al.), and U.S. Pat. No. 6,800,226 (Gerking), and DE 19929709 C2 (Gerking).

Suitable processes for forming sub-micrometer fibers also include electrospinning processes, for example, those processes described in U.S. Pat. No. 1,975,504 (Formhals). Other suitable processes for forming sub-micrometer fibers are described in U.S. Pat. Nos. 6,114,017 (Fabbricante et al.); U.S. Pat. No. 6,382,526 B1 (Reneker et al.); and U.S. Pat. No.6,861,025 B2 (Erickson et al.).

The methods of making dimensionally stable nonwoven fibrous webs of the present disclosure may be used to form a sub-micrometer fiber component containing fibers formed from any of the above-mentioned polymeric materials. Typically, the sub-micrometer fiber forming method step involves melt extruding a thermoformable material at a melt extrusion temperature ranging from about 130° C. to about 350° C. A die assembly and/or coaxial nozzle assembly (see, for example, the Torobin process referenced above) comprises a population of spinnerets and/or coaxial nozzles through which molten thermoformable material is extruded. In one exemplary embodiment, the coaxial nozzle assembly comprises a population of coaxial nozzles formed into an array so as to extrude multiple streams of fibers onto a support layer or substrate. See, for example, U.S. Pat. Nos. 4,536,361 (FIG. 2) and U.S. Pat. No. 6,183,670 (FIGS. 1-2).

2. Formation of Microfibers

A number of processes may be used to produce and deposit microfibers, including, but not limited to, melt blowing, melt spinning, filament extrusion, plexifilament formation, spunbonding, wet spinning, dry spinning, or a combination thereof. Suitable processes for forming microfibers are described in U.S. Pat. Nos. 6,315,806 (Torobin); U.S. Pat. No. 6,114,017 (Fabbricante et al.); U.S. Pat. No. 6,382,526 B1 (Reneker et al.); and U.S. Pat. No. 6,861,025 B2 (Erickson et al.). Alternatively, a population of microfibers may be formed or converted to staple fibers and combined with a population of sub-micrometer fibers using, for example, using a process as described in U.S. Pat. No. 4,118,531 (Hauser). In certain exemplary embodiments, the population of microfibers comprises a web of bonded microfibers, wherein bonding is achieved using thermal bonding, adhesive bonding, powdered binder, hydroentangling, needlepunching, calendering, or a combination thereof, as described below.

3. Apparatus for Forming Dimensionally Stable Nonwoven Fibrous Webs

A variety of equipment and techniques are known in the art for melt processing polymeric fine fibers. Such equipment and techniques are disclosed, for example, in U.S. Pat. No. 3,565,985 (Schrenk et al.); U.S. Pat. No. 5,427,842 (Bland et. al.); U.S. Pat. Nos. 5,589,122 and 5,599,602 (Leonard); and U.S. Pat. No. 5,660,922 (Henidge et al.). Examples of melt processing equipment include, but are not limited to, extruders (single and twin screw), Banbury mixers, and Brabender extruders for melt processing the inventive fine fibers.

The (BMF) meltblowing process is one particular exemplary method of forming a nonwoven web of molecularly unoriented fibers where a polymer fluid, either molten or as a solution, is extruded through one or more rows of holes then impinged by a high velocity gas jet. The gas jet, typically heated air, entrains and draws the polymer fluid and helps to solidify the polymer into a fiber. The solid fiber is then collected on solid or porous surface as a nonwoven web. This process is described by Van Wente in "Superfine Thermoplastic Fibers", *Industrial Engineering Chemistry, vol.* 48, pp. 1342-1346. An improved version of the meltblowing process is described by Buntin et al. as described in U.S. Pat. No. 3,849,241.

As part of an exemplary BMF process for making fine fibers, a thermoplastic polyester and polypropylene in a melt form may be mixed in a sufficient amount relative to an optional viscosity modifier to yield fine fibers having average diameter characteristics as described hereinabove. The ingredients of the fine fibers may be mixed in and conveyed through an extruder to yield a polymer, preferably without substantial polymer degradation or uncontrolled side reactions in the melt. The processing temperature is sufficient to mix the biodegradable aliphatic polyester viscosity modifier, and allow extruding the polymer. Potential degradation reactions include transesterification, hydrolysis, chain scission and radical chain define fibers, and process conditions should minimize such reactions.

The viscosity modifiers in the present disclosure need not be added to the fiber extrusion process in a pure state. The viscosity modifiers may be compounded with the aliphatic polyester, or other materials prior to extrusion. Commonly, when additives such as viscosity modifiers are compounded prior to extrusion, they are compounded at a higher concentration than desired for the final fiber. This high concentration compound is referred to as a master batch. When a master batch is used, the master batch will generally be diluted with pure polymer prior to entering the fiber extrusion process. Multiple additives may be present in a masterbatch, and multiple master batches may be used in the fiber extrusion process.

An alternative melt blown process that may benefit from the use of viscosity modifiers as provided herein is described in U.S. Patent Application Publication No. 2008/0160861.

Depending on the condition of the microfibers and sub-micrometer fibers, some bonding may occur between the fibers during collection. However, further bonding between the microfibers in the collected web is usually needed to provide a matrix of desired coherency, making the web more handleable and better able to hold the sub-micrometer fibers within the matrix ("bonding" fibers means adhering the fibers together firmly, so they generally do not separate when the web is subjected to normal handling).

Conventional bonding techniques using heat and pressure applied in a point-bonding process or by smooth calendar rolls can be used, though such processes may cause undesired deformation of fibers or compaction of the web. A more preferred technique for bonding the microfibers is taught in U.S. Patent Application Publication No. 2008/0038976. Apparatus for performing this technique is illustrated in FIGS. 1, 5 and 6 of the drawings.

In brief summary, as applied to the present disclosure, this preferred technique involves subjecting the collected web of microfibers and sub-micrometer fibers to a controlled heating and quenching operation that includes a) forcefully passing through the web a gaseous stream heated to a temperature sufficient to soften the microfibers sufficiently to cause the microfibers to bond together at points of fiber intersection (e.g., at sufficient points of intersection to form a coherent or bonded matrix), the heated stream being applied for a discrete time too short to wholly melt the fibers, and b) immediately forcefully passing through the web a gaseous stream at a temperature at least 50° C. no greater than the heated stream to quench the fibers (as defined in the above-mentioned U.S. Patent Application Publication No. 2008/0038976, "forcefully" means that a force in addition to normal room pressure is applied to the gaseous stream to propel the stream through the web; "immediately" means as part of the same operation, i.e., without an intervening time of storage as occurs when a web is wound into a roll before the next processing step). As a shorthand term this technique is described as the quenched flow heating technique, and the apparatus as a quenched flow heater.

It has been found that the sub-micrometer fibers do not substantially melt or lose their fiber structure during the bonding operation, but remain as discrete microfibers with their original fiber dimensions. Without wishing to be bound by any particular theory, Applicant's believe that sub-micrometer fibers have a different, less crystalline morphology than microfibers, and we theorize that the limited heat applied to the web during the bonding operation is exhausted in developing crystalline growth within the sub-micrometer fibers before melting of the sub-micrometer fibers occurs. Whether this theory is correct or not, bonding of the microfibers without substantial melting or distortion of the sub-micrometer fibers does occur and may be beneficial to the properties of the finished web.

A variation of the described method, taught in more detail in the aforementioned U.S. Patent Application Publication No. 2008/0038976, takes advantage of the presence of two different kinds of molecular phases within microfibers—one kind called crystallite-characterized molecular phases because of a relatively large presence of chain-extended, or strain-induced, crystalline domains, and a second kind called amorphous-characterized phases because of a relatively large presence of domains of lower crystalline order (i.e., not chain-extended) and domains that are amorphous, though the latter may have some order or orientation of a degree insufficient for crystallinity. These two different kinds of phases, which need not have sharp boundaries and can exist in mixture with one another, have different kinds of properties, including different melting and/or softening characteristics: the first phase characterized by a larger presence of chain-extended crystalline domains melts at a temperature (e.g., the melting point of the chain-extended crystalline domain) that is higher than the temperature at which the second phase melts or softens (e.g., the glass transition temperature of the amorphous domain as modified by the melting points of the lower-order crystalline domains).

In the stated variation of the described method, heating is at a temperature and for a time sufficient for the amorphous-characterized phase of the fibers to melt or soften while the crystallite-characterized phase remains unmelted. Generally, the heated gaseous stream is at a temperature greater than the onset melting temperature of the polymeric material of the fibers. Following heating, the web is rapidly quenched as discussed above.

Treatment of the collected web at such a temperature is found to cause the microfibers to become morphologically refined, which is understood as follows (we do not wish to be bound by statements herein of our "understanding," which generally involve some theoretical considerations). As to the amorphous-characterized phase, the amount of molecular material of the phase susceptible to undesirable (softening-impeding) crystal growth is not as great as it was before treatment. The amorphous-characterized phase is understood to have experienced a kind of cleansing or reduction of molecular structure that would lead to undesirable increases in crystallinity in conventional untreated fibers during a thermal bonding operation. Treated fibers of certain exemplary embodiments of the present invention may be capable of a kind of "repeatable softening," meaning that the fibers, and particularly the amorphous-characterized phase of the fibers, will undergo to some degree a repeated cycle of softening and resolidifying as the fibers are exposed to a cycle of raised and lowered temperature within a temperature region lower than that which would cause melting of the whole fiber.

In practical terms, repeatable softening is indicated when a treated web (which already generally exhibits a useful bonding as a result of the heating and quenching treatment) can be heated to cause further autogenous bonding of the fibers. The cycling of softening and resolidifying may not continue indefinitely, but it is generally sufficient that the fibers may be initially bonded by exposure to heat, e.g., during a heat treatment according to certain exemplary embodiments of the present invention, and later heated again to cause re-softening and further bonding, or, if desired, other operations, such as calendering or re-shaping. For example, a web may be calendered to a smooth surface or given a nonplanar shape, e.g., molded into a face mask, taking advantage of the improved bonding capability of the fibers (though in such cases the bonding is not limited to autogenous bonding).

While the amorphous-characterized, or bonding, phase has the described softening role during web-bonding, calendering, shaping or other like operation, the crystallite-characterized phase of the fiber also may have an important role, namely to reinforce the basic fiber structure of the fibers. The crystallite-characterized phase generally can remain unmelted during a bonding or like operation because its melting point is higher than the melting/softening point of the amorphous-characterized phase, and it thus remains as an intact matrix that extends throughout the fiber and supports the fiber structure and fiber dimensions.

Thus, although heating the web in an autogenous bonding operation may cause fibers to weld together by undergoing some flow and coalescence at points of fiber intersection, the basic discrete fiber structure is substantially retained over the length of the fibers between intersections and bonds; preferably, the cross-section of the fibers remains unchanged over the length of the fibers between intersections or bonds formed during the operation. Similarly, although calendering of a web may cause fibers to be reconfigured by the pressure and heat of the calendering operation (thereby causing the fibers to permanently retain the shape pressed upon them during calendering and make the web more uniform in thickness), the fibers generally remain as discrete fibers with a consequent retention of desired web porosity, filtration, and insulating properties.

One aim of the quenching is to withdraw heat before undesired changes occur in the microfibers contained in the web. Another aim of the quenching is to rapidly remove heat from the web and the fibers and thereby limit the extent and nature of crystallization or molecular ordering that will subsequently occur in the fibers. By rapid quenching from the molten/softened state to a solidified state, the amorphous-characterized phase is understood to be frozen into a more purified crystalline form, with reduced molecular material that can interfere with softening, or repeatable softening, of the fibers. For some purposes, quenching may not be absolutely required though it is strongly preferred for most purposes.

To achieve quenching the mass is desirably cooled by a gas at a temperature at least 50° C. no greater than the nominal melting point; also the quenching gas is desirably applied for a time on the order of at least one second (the nominal melting point is often stated by a polymer supplier; it can also be identified with differential scanning calorimetry, and for purposes herein, the "Nominal Melting Point" for a polymer is defined as the peak maximum of a second-heat, total-heat-flow DSC plot in the melting region of a polymer if there is only one maximum in that region; and, if there are more than one maximum indicating more than one melting point (e.g., because of the presence of two distinct crystalline phases), as the temperature at which the highest-amplitude melting peak occurs). In any event the quenching gas or other fluid has sufficient heat capacity to rapidly solidify the fibers.

One advantage of certain exemplary embodiments of the present invention may be that the sub-micrometer fibers held within a microfiber web may be better protected against compaction than they would be if present in an all-sub-micrometer fiber layer. The microfibers are generally larger, stiffer and stronger than the sub-micrometer fibers, and they can be made from material different from that of the microfibers. The presence of the microfibers between the sub-micrometer fibers and an object applying pressure may limit the application of crushing force on the sub-micrometer fibers. Especially in the case of sub-micrometer fibers, which can be quite fragile, the increased resistance against compaction or crushing that may be provided by certain exemplary embodiments of the present invention offers an important benefit. Even when webs according to the present disclosure are subjected to pressure, e.g., by being rolled up in jumbo storage rolls or in secondary processing, webs of the present disclosure may offer good resistance to compaction of the web, which could otherwise lead to increased pressure drop and poor loading performance for filters. The presence of the microfibers also may add other properties such as web strength, stiffness and handling properties.

The diameters of the fibers can be tailored to provide needed filtration, acoustic absorption, and other properties. For example it may be desirable for the microfibers to have a median diameter of 5 to 50 micrometers (μm) and the sub-micrometer fibers to have a median diameter from 0.1 μm to no greater than 1 μm, for example, 0.9 μm. Preferably the microfibers have a median diameter between 5 μm and 50 μm, whereas the sub-micrometer fibers preferably have a median diameter of 0.5 μm to no greater than 1 μm, for example, 0.9 μm.

As previously stated, certain exemplary embodiments of the present invention may be particularly useful to combine very small microfibers, for example ultrafine microfibers having a median diameter of from 1 μm to about 2 μm, with the sub-micrometer fibers. Also, as discussed above, it may be desirable to form a gradient through the web, e.g., in the relative proportion of sub-micrometer fibers to microfibers over the thickness of the web, which may be achieved by varying process conditions such as the air velocity or mass rate of the sub-micrometer fiber stream or the geometry of the intersection of the microfiber and sub-micrometer fiber streams, including the distance of the die from the microfiber stream and the angle of the sub-micrometer fiber stream. A higher concentration of sub-micrometer fibers near one edge of a dimensionally stable nonwoven fibrous web according to the present disclosure may be particularly advantageous for gas and/or liquid filtration applications.

In preparing microfibers or sub-micrometer fibers according to various embodiments of the present disclosure, different fiber-forming materials may be extruded through different orifices of a meltspinning extrusion head or meltblowing die so as to prepare webs that comprise a mixture of fibers. Various procedures are also available for electrically charging a dimensionally stable nonwoven fibrous web to enhance its filtration capacity: see e.g., U.S. Pat. No. 5,496,507 (Angadjivand).

If a web could be prepared from the sub-micrometer fibers themselves, such a web would be flimsy and weak. However, by incorporating the population of sub-micrometer fibers with a population of microfibers in a coherent, bonded, oriented composite fibrous structure, a strong and self-supporting web or sheet material can be obtained, either with or without an optional support layer.

In addition to the foregoing methods of making a dimensionally stable nonwoven fibrous web, one or more of the following process steps may be carried out on the web once formed:

(1) advancing the dimensionally stable nonwoven fibrous web along a process pathway toward further processing operations;

(2) bringing one or more additional layers into contact with an outer surface of the sub-micrometer fiber component, the microfiber component, and/or the optional support layer;

(3) calendering the dimensionally stable nonwoven fibrous web;

(4) coating the dimensionally stable nonwoven fibrous web with a surface treatment or other composition (e.g., a fire retardant composition, an adhesive composition, or a print layer);

(5) attaching the dimensionally stable nonwoven fibrous web to a cardboard or plastic tube;

(6) winding-up the dimensionally stable nonwoven fibrous web in the form of a roll;

(7) slitting the dimensionally stable nonwoven fibrous web to form two or more slit rolls and/or a plurality of slit sheets;

(8) placing the dimensionally stable nonwoven fibrous web in a mold and molding the dimensionally stable nonwoven fibrous web into a new shape;

(9) applying a release liner over an exposed optional pressure-sensitive adhesive layer, when present; and

(10) attaching the dimensionally stable nonwoven fibrous web to another substrate via an adhesive or any other attachment device including, but not limited to, clips, brackets, bolts/screws, nails, and straps.

D. Articles Formed from Dimensionally Stable Nonwoven Fibrous Webs

The present disclosure is also directed to methods of using the dimensionally stable nonwoven fibrous webs of the present disclosure in a variety of applications. In a further aspect, the disclosure relates to an article comprising a dimensionally stable nonwoven fibrous web according to the present disclosure. In exemplary embodiments, the article may be used as a gas filtration article, a liquid filtration article, a sound absorption article, a thermal insulation article, a surface cleaning article, a cellular growth support article, a drug delivery article, a personal hygiene article, a dental hygiene article, a surgical drape, a surgical equipment isolation drape, a surgical gown, a medical gown, healthcare patient gowns and attire, an apron or other apparel, a sterilization wrap, a wipe, agricultural fabrics, food packaging, packaging, or a wound dressing article.

For example, a dimensionally stable nonwoven fibrous web of the present disclosure may be advantageous in gas filtration applications due to the reduced pressure drop that results from lower Solidity. Decreasing the Solidity of a sub-micrometer fiber web will generally reduce its pressure drop. Lower pressure drop increase upon particulate loading of low Solidity sub-micrometer dimensionally stable nonwoven fibrous web of the present disclosure may also result. Current technology for forming particle-loaded sub-micrometer fibers results in much higher pressure drop than for coarser microfiber webs, partially due to the higher Solidity of the fine sub-micrometer fiber web.

In addition, the use of sub-micrometer fibers in gas filtration may be particularly advantageous due to the improved particle capture efficiency that sub-micrometer fibers may provide. In particular, sub-micrometer fibers may capture small diameter airborne particulates better than coarser fibers. For example, sub-micrometer fibers may more efficiently capture airborne particulates having a dimension smaller than about 1000 nanometers (nm), more preferably smaller than about 500 nm, even more preferably smaller than about 100 nm, and most preferably below about 50 nm. Gas filters such as this may be particularly useful in personal protection respirators; heating, ventilation and air conditioning (HVAC) filters; automotive air filters (e.g. automotive engine air cleaners, automotive exhaust gas filtration, automotive passenger compartment air filtration); and other gas-particulate filtration applications.

Liquid filters containing sub-micrometer fibers in the form of dimensionally stable nonwoven fibrous webs of the present disclosure may also have the advantage of improved depth loading while maintaining small pore size for capture of sub-micrometer, liquid-borne particulates. These properties improve the loading performance of the filter by allowing the filter to capture more of the challenge particulates without plugging.

A fiber-containing dimensionally stable nonwoven fibrous web of the present disclosure may also be a preferred substrate for supporting a membrane. The low Solidity fine web could act a both a physical support for the membrane, but also as a depth pre-filter, enhancing the life of the membrane. The use of such a system could act as a highly effective symmetric or asymmetric membrane. Applications for such membranes include ion-rejection, ultrafiltration, reverse osmosis, selective binding and/or adsorption, and fuel cell transport and reaction systems.

Dimensionally stable nonwoven fibrous webs of the present disclosure may also be useful synthetic matrices for promoting cellular growth. The open structure with fine sub-micrometer fibers may mimic naturally occurring systems and promotes more in vivo-like behavior. This is in contrast to current products (such as Donaldson ULTRA-WEBT™ Synthetic ECM, available from Donaldson Corp., Minneapolis, Minn.) where high Solidity fiber webs act as a synthetic support membrane, with little or no penetration of cells within the fiber matrix.

The structure provided by the dimensionally stable nonwoven fibrous webs of the present disclosure may also be an effective wipe for surface cleaning, where the fine sub-micrometer fibers form a soft wipe, while low Solidity may have the advantage of providing a reservoir for cleaning agents and high pore volume for trapping debris.

For acoustic and thermal insulation applications, providing the fine sub-micrometer fibers in a low Solidity form improves acoustic absorbance by exposing more of the surface area of the sub-micrometer fibers, as well as specifically improving low frequency acoustic absorbance by allowing for a thicker web for a given basis weight. In thermal insulation applications in particular, a fine sub-micrometer fiber insulation containing sub-micrometer fibers would have a soft feel and high drapability, while providing a very low Solidity web for trapping insulating air. In some embodiments, the nonwoven web may comprise hollow fibers or filaments or fibers containing gas voids. A spunbond process may be used to prepare nonwoven fabric of continuous, hollow fibers or filaments containing voids that are particularly useful for acoustic and thermal insulation; the voids may allow for an improvement in acoustic damping, reduction in thermal conductivity, and a reduction in weight of the dimensionally stable nonwoven fibrous webs and articles made therefrom.

In some embodiments of a use of such an acoustic and/or thermal insulation article, an entire area may be surrounded by a dimensionally stable nonwoven fibrous web prepared according to embodiments of the present disclosure, provided alone or on a support layer. The support structure and the fibers comprising the dimensionally stable nonwoven fibrous web may, but need not be homogeneously dispersed within one another. There may be advantages in cushioning, resiliency and filter loading for asymmetric loading to provide ranges of pore sizes, higher density regions, exterior skins or flow channels.

The fine fibers are particularly useful for making absorbent or repellent aliphatic polyester nonwoven gowns and film laminate drapes used in surgery as well as personal care absorbents such as feminine hygiene pads, diapers, incontinence pads, wipes, fluid filters, insulation and the like.

Various embodiments of the presently disclosed invention also provides useful articles made from fabrics and webs of fine fibers including medical drapes, medical gowns, aprons, filter media, industrial wipes and personal care and home care products such as diapers, facial tissue, facial wipes, wet wipes, dry wipes, disposable absorbent articles and garments such as disposable and reusable garments including infant diapers or training pants, adult incontinence products, feminine hygiene products such as sanitary napkins and panty liners and the like. The fine fibers of this invention also may be useful for producing thermal insulation for garments such as coats, jackets, gloves, cold weather pants, boots, and the like as well as acoustical insulation.

In yet another aspect, this invention provides multi-layer, aqueous liquid-absorbent articles comprising an aqueous media impervious backing sheet. For example, importantly some surgical drapes are liquid impervious to prevent liquid that is absorbed into the top sheet from wicking through to the skin surface where it would be contaminated with bacteria present on the skin. In other embodiments the construction may further comprise an aqueous media permeable topsheet, and an aqueous liquid-absorbent (i.e., hydrophilic) layer constructed of the above-described web or fabric juxtaposed there between useful, for instance, in constructing disposable diapers, wipes or towels, sanitary napkins, and incontinence pads.

In yet another aspect, a single or multi-layer aqueous repellent article such as a surgical or medical gown or apron can be formed at least in part of a web of fine fibers described herein, and having aqueous fluid repellent properties. For example, an SMS web may be formed having fine fibers in at least the M (melt blown, blow microfiber) layer but they may also comprise the S (spunbond layer as well). The M layer may have further incorporated therein a repellent additive such as a fluorochemical. In this manner, the gown is rendered fluid repellent to avoid absorption of blood or other body fluids that may contain pathogenic microorganisms. Alternatively, the web may be post treated with a repellent finish such as a fluorochemical.

In yet another aspect, a wrap may be formed that is used to wrap clean instruments prior to surgery or other procedure requiring sterile tools. These wraps allow penetration of sterilizing gasses such as steam, ethylene oxide, hydrogen peroxide, etc. but they do not allow penetration of bacteria. They may be made of a single or multi-layer aqueous repellent article such as a sterilization wrap can be formed at least in part of a web of fine fibers described herein, and having aqueous fluid repellent properties. For example, a SMS, SMMS, or other nonwoven construction web may be formed having fine fibers in at least the M (melt blown, blown microfiber) layer but they may also comprise the S (spunbond layer as well). The M layer may have further incorporated therein or thereon a repellent additive such as a fluorochemical.

Preferred fluorochemicals comprise a perfluoroalkyl group having at least 4 carbon atoms. These fluorochemicals may be small molecules, oligomers, or polymers. Suitable fluorochemicals may be found in U.S. Pat. No. 6,127,485 (Klun at al.) and U.S. Pat. No. 6,262,180 (Klun et al). Other suitable repellants may include fluorochemicals and silicone fluids repellents disclosed in U.S. Ser. No. 61/061,091, filed Jun. 12, 2008, and PCT Publication No. WO 2009/152349. In some instances hydrocarbon type repellents may be suitable.

A sterilization wrap constructed from such a single or multi-layer repellent article described herein possesses all of the properties required of a sterilization wrap; i.e., permeability to steam or ethylene oxide or other gaseous sterilant during sterilization (and during drying or aeration) of the articles it encloses, repellency of liquid water during storage to avoid contamination of the contents of the wrap by water-borne contaminants, and a tortuous path barrier to contamination by air- or water-borne microbes during storage of the sterilized pack.

The fine fiber webs of exemplary embodiments of the presently disclosed invention may be rendered more repellent by treatment with numerous compounds. For example, the fabrics may be post web forming surface treatments which include paraffin waxes, fatty acids, bee's wax, silicones, fluorochemicals and combinations thereof. For example, the repellent finishes may be applied as disclosed in U.S. Pat. Nos. 5,027,803; 6,960,642; and 7,199,197. Repellent finishes may also be melt additives such as those described in U.S. Pat. No. 6,262,180.

Articles comprising the dimensionally stable nonwoven fibrous webs of the present disclosure may be made by processes known in the art for making products like polymer sheets from polymer resins. For many applications, such articles can be placed in water at 23° C. without substantial loss of physical integrity (e.g. tensile strength) after being immersed 2 hours and dried. Typically, these articles contain little or no water. The water content in the article after extruding, injection molding or solvent casting is typically no greater than 10% by weight, preferably no greater than 5% by weight, more preferably no greater than 1% by weight and most preferably no greater than 0.2% by weight.

Articles that may be made of dimensionally stable nonwoven fibrous webs of the present disclosure may include medical drapes and gowns, including surgical drapes, procedural drapes, plastic specialty drapes, incise drapes, barrier drapes, barrier gowns, SMS, SMMS, or other nonwoven gowns, SMS, SMMS, or other nonwoven sterilization wraps, and the like, wound dressings, wound absorbents, wound contact layers, surgical sponges use to absorb blood and body fluids during surgery, surgical implants, and other medical devices. Articles made of the dimensionally stable nonwoven fibrous webs of the present disclosure may be solvent, heat, or ultrasonically welded together as well as being welded to other compatible articles. The dimensionally stable nonwoven fibrous webs of the present disclosure may be used in conjunction with other materials to form constructions such as sheath/core materials, laminates, compound structures of two or more materials, or useful as coatings on various medical devices. The dimensionally stable nonwoven fibrous webs described herein may be particularly useful in the fabrication of surgical sponges.

Some of the preferred hydrophilic additive surfactants of the present invention may allow for adhesive, thermal, and/or ultrasonic bonding of fabrics and films made thereof. Exemplary dimensionally stable nonwoven fibrous webs of the present disclosure may be particularly suitable for use in surgical drapes and gowns. Exemplary non-woven web and sheets comprising the dimensionally stable nonwoven fibrous webs of the present disclosure can be heat sealed to form strong bonds allowing specialty drape fabrication; can be made from renewable resources which can be important in disposable products; and can have high surface energy to allow wettability and fluid absorbency in the case of nonwovens. In other applications a low surface energy may be desirable to impart fluid repellency.

It is believed that certain dimensionally stable nonwoven fibrous webs of the present disclosure can be sterilized by gamma radiation or electron beam without significant loss of physical strength (tensile strength for a 1 mil thick film does not decrease by more than 20% and preferably by not more than 10% after exposure to 2.5 Mrad gamma radiation from a cobalt gamma radiation source and aged at 23°-25° C. for 7 days.

The hydrophilic characteristic of some exemplary dimensionally stable nonwoven fibrous webs of the present disclosure may improve articles such as wound and surgical dressings by improving absorbency. If the fine fibers is used in a wound dressing backing film, the film may be partially (e.g. zone or pattern) coated or completely coated with various adhesives, including but not limited to pressure sensitive adhesives (PSAs), such as acrylic and block copolymer adhesives, hydrogel adhesives, hydrocolloid adhesives, and foamed adhesives. PSAs can have a relatively high moisture vapor transmission rate to allow for moisture evaporation.

Suitable pressure sensitive adhesives include those based on acrylates, polyurethanes, KRATON and other block copolymers, silicones, rubber based adhesives as well as combinations of these adhesives. The preferred PSAs are the normal adhesives that are applied to skin such as the acrylate copolymers described in U.S. Pat. No. RE 24,906, particularly a 97:3 iso-octyl acrylate:acrylamide copolymer. Also preferred is an 70:15:15 iso-octyl acrylate-ethyleneoxide acrylate: acrylic acid terpolymer, as described in U.S. Pat. No. 4,737,410 (Example 31). Other useful adhesives are described in U.S. Pat. Nos. 3,389,827; 4,112,213; 4,310,509 and 4,323,557. Inclusion of medicaments or antimicrobial agents in the adhesive is also contemplated, as described in U.S. Pat. Nos. 4,310,509 and 4,323,557.

Other medical devices that may be made, in whole or in part, of exemplary dimensionally stable nonwoven fibrous webs of the present disclosure include: sutures, suture fasteners, surgical mesh, slings, orthopedic pins (including bone filling augmentation material), adhesion barriers, stents, guided tissue repair/regeneration devices, articular cartilage repair devices, nerve guides, tendon repair devices, atrial septal defect repair devices, pericardial patches, bulking and filling agents, vein valves, bone marrow scaffolds, meniscus regeneration devices, ligament and tendon grafts, ocular cell implants, spinal fusion cages, skin substitutes, dural substitutes, bone graft substitutes, bone dowels, and hemostats.

The dimensionally stable nonwoven fibrous webs of the present disclosure may also be useful in consumer hygiene products, such as adult incontinence, infant diapers, feminine hygiene products, and others as described in U.S. Patent Application Publication No. 2008/0200890.

EXAMPLES

Exemplary embodiments of dimensionally stable nonwoven fibrous webs of the presently disclosed invention will be further clarified by the following examples which are not intended to limit the scope of the invention.

Example 1

Spunbond PLA with Polypropylene

Nonwoven webs were made using the spunbond process from neat poly(lactic acid) (PLA) and a mixture of PLA and polypropylene (PP). The PLA used was grade 6202D from Natureworks, LLC (Minnetonka, Minn.). The PP used was grade 3860× from Total Petrochemicals (Houston, Tex.). One sample also contained a 50/50 mixture Dioctyl sulfosuccinate sodium salt (DOSS) and poly(ethylene glycol) (PEG) as a plasticizer, diluent, and hydrophilic surfactant. The DOSS/PEG mixture was compounded with 6202D PLA and added as a master batch to the spunbond process.

The spunbond apparatus used is that described in U.S. Pat. No. 6,196,752 (Berrigan et al.). The extruder used was a 2 inch single screw extruder from Davis-Standard (Pawcatuck, Conn.). The die used had an effective width of 7.875 inches and was fed polymer melt from a metering pump at the rate of 42 pounds per hour. The die had 648 holes, each hole being 0.040 inches in diameter with a L/D of 6. The extrusion temperature was 230° C. The air attenuator was set at a pressure of 5 pounds per square inch. Process conditions were kept constant for the different mixtures. Spinning speed is the filament speed calculated using the final average fiber diameter, measured microscopically, and the polymer rate per hole. In all cases the spinning speed is no greater than 2500 meters per minute, the speed at which strain induced crystallization begins in PLA.

After extrusion the webs were also measured for shrinkage by placing an unrestrained 10 cm×10 cm square section cut from the middle of each web using a die cutter onto an aluminum tray in a convection oven at 80° C. overnight (e.g., for approximately 14 hours). The Tg of the PLA webs was approximately 54-56° C. The heated samples were then allowed to cool and measured for length (in the machine direction) and width (in the cross direction), and the average linear shrinkage of three samples was reported. The shrinkage reported was the average change of three samples in sample length and width, as opposed to change in sample area.

TABLE I

Results for Example 1

| Material | Fiber Diameter (micrometers) | Spinning Speed (m/min) | 80° C. Shrinkage (linear %) |
|---|---|---|---|
| Neat 6202D PLA | 15 | 2121 | 5.56 |
| 6202D + 3% PP | 17 | 1651 | 2.84 |
| 6202D + 3% DOSS/PEG + 3% PP | 18 | 1473 | 7.61 |

Birefringence studies using a polarized microscope were performed on some of the prepared webs to examine the degree of orientation within the web and within fibers. Retardation was estimated using the Michel-Levy chart, and birefringence number determined. Representative samples were also analyzed to identify variation in birefringence in fibers at constant diameter. Fibers of constant diameter were studied, although the fiber sections studied were not necessarily from the same fiber. The results found for Example 4 are presented in the following Table 2. As seen, different colors were also detected. Similar variation in birefringence at constant diameter was found for the other examples.

Example 2

Meltblown PLA with Polypropylene

Nonwoven webs were produced using a meltblowing process from poly(lactic acid), PLA, and polypropylene, PP. The PLA used was grade 6251D from Natureworks, LLC, (Minnetonka, Minn.). The PP used was grade 3960 from Total Petrochemicals (Houston, Tex.).

The meltblowing apparatus consisted of a twin screw extruder, and metering pump, and a meltblowing die. The extruder used was a 31 mm conical twin screw extruder (C.W. Brabender Instruments (South Hackensack, N.J.). After the extruder a positive displacement gear pump was used to meter and pressurize the polymer melt. The metered melt was sent to a drilled orifice meltblowing die. Drilled orifice meltblowing dies are described in U.S. Pat. No. 3,825,380. The die used was 10 inches wide with 20 polymer orifices per inch of width, each orifice being 0.015 inches in diameter. The die was operated at a temperature of 225° C. Different mixtures of polymer pellets were fed to the process with amounts of PP added to the PLA. Process conditions were kept constant throughout the experiment.

The webs were collected on a vacuum collector and wound up onto cores using a surface winder. Fiber diameter was measured using the airflow resistance technique described by Davies (Davies, C. N., *The Separation of Airborne Dust and Particles*, Inst. of Mech. Engineers, London, Proceedings 1B, 1952), this measurement is referred to as Effective Fiber Diameter or EFD. Shrinkage was measured using the technique described in Example 1.

Some samples expanded during heating, and these samples are reported as having negative shrinkage values.

TABLE II

Example 2 Results

| Material | Eff. Fiber Diameter (micrometers) | 80° C. Shrinkage (linear %) |
|---|---|---|
| Neat 6251D PLA | 15.7 | 12.25 |
| 1% 3960 PP in 6251D | 15.8 | 2.08 |
| 2% 3960 PP in 6251D | 15.8 | 1.83 |
| 4% 3960 PP in 6251D | 16.4 | −0.08 |
| 8% 3960 PP in 6251D | 15.7 | −1.50 |

Example 3

Meltblown PLA with Viscosity Modifying Salts

Nonwoven webs were produced using the meltblowing process using PLA and a number of salts that greatly reduce the apparent viscosity of the melt during processing. The fiber diameters of the finished nonwoven webs were also smaller when the salts are added. Polypropylene was also added to some mixtures to reduce the shrinkage of the nonwoven webs. The resulting web had the properties of both reduced fiber diameter and reduced shrinkage. The polypropylene used was grade 3960 from Total Petrochemicals (Houston, Tex.). The PLA used was grade 6251D from Natureworks, LLC (Minnetonka, Minn.). The additives tested included:

Calcium Stearoyl Lactylate (CSL) (Trade name Pationic CSL, fom RITA Corp. (Crystal Lake, Ill.);

Sodium Stearoyl Lactylate (SSL) (trade name Pationic SSL from RITA Corp. (Crystal Lake, Ill.);

Calcium Stearate (Ca—S) from Aldrich (St. Louis, Mo.);

Sodium Behenoyl Lactylate (SBL) (trade name Pationic SBL) from RITA Corp (Crystal Lake, Ill.).

The chemical structure of CSL is shown in FIG. 1. The chemical structure of SBL is shown in FIG. 2.

Figure 1: Chemical Structure of Calcium Stearoyl Lactylate (from RITA Corp.)

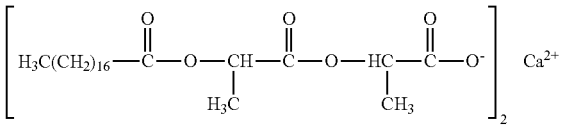

Figure 2: Chemical Structure of Sodium Behenoyl Lactylate

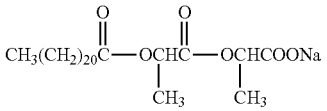

The meltblowing process is the same as that used in Example 2. The process was operated with a die temperature of 225° C. The salts were added to the system by dry blending the powder with warm PLA pellets from the polymer dryer. The resin was predried by heating to 71 C overnight. The salt additive melted on contact with the warm PLA pellets and was blended by hand to form slightly sticky pellets that were then fed to the extruder.

After extrusion the webs were tested for EFD and thermal shrinkage using the same methods as in previous examples. The pressure of the polymer entering the die was recorded as a surrogate for polymer viscosity. In this manner any decrease in apparent viscosity of the melt is seen as a decrease in pressure at the die entrance.

TABLE III

Example 3 Results

| Material | Die Entrance Pressure (psi) | Eff. Fiber Diameter (micrometers) | 80° C. Shrinkage (linear %) |
|---|---|---|---|
| Neat 6251D PLA | 431 | 16.8 | 13.16 |
| 0.5% CSL in 6251D | 142 | 11.7 | 13.91 |
| 0.75% CSL in 6251D | 122 | 11.1 | 8.50 |
| 1.0% CSL in 6251D | 62 | 8.8 | 17.50 |
| 2% SSL in 6251D | 425 | 12.7 | 29.0 |
| 2% SBL in 6251D | 69 | 5.5 | 19.25 |
| 1% Ca—S in 6251D | 83 | 10.0 | 10.25 |
| 2% Ca—S in 6251D | 44 | 8.0 | 23.08 |
| 0.5% CSL, 4% PP in 6251D | 401 | 13.5 | −3.47 |
| 1% CSL, 4% PP in 6251D | 323 | 11.4 | −1.62 |
| 1.5% CSL, 4% PP in 6251D | 387 | 11.3 | −0.67 |
| 1.0% CSL, 2% PP in 6251D | 415 | 10.4 | −3.47 |
| 1.0% CSL, 6% PP in 6251D | 292 | 11.0 | −1.93 |

Example 4

Meltblown PET with Polypropylene

Fiber webs of were made using the meltblowing process with blends of PP in PET. The PET resin used was grade 8603A from Invista (Wichita, Kans.). The polypropylene used was grade 3868 from Total Petrochemicals (Houston, Tex.).

The meltblowing apparatus used consisted of a single screw extruder, and metering pump, and a meltblowing die. The extruder used was a 2" single screw extruder (David Standard, Pawcatuck, Conn.). After the extruder a positive displacement gear pump was used to meter and pressurize the polymer melt. The metered melt was sent to a drilled orifice meltblowing die. Drilled orifice meltblowing dies are described in U.S. Pat. No. 3,825,380. The die used was 20 inches wide with 25 polymer orifices per inch of width, each orifice being 0.015 inches in diameter. Blending was accomplished by feeding a dry-blended mixture of the PET and PP pellets to the extruder. Process conditions were kept constant for the different mixtures.

After the nonwoven webs were formed, they were tested for shrinkage in the same manner as the previous PLA samples. However due to the higher glass transition of PET the convection oven was set to 150° C., rather than the previous 80° C.

TABLE IV

Example 4 Results

| Material | 150° C. Shrinkage (Linear %) |
|---|---|
| Neat 8603F | 30.08 |
| 8603F + 3% PP | 7.17 |
| 8603F + 5% PP | 4.17 |
| 8603F + 10% PP | 2.00 |

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. Furthermore, all publications, published patent applications and issued patents referenced herein are incorporated by reference in their entirety to the same extent as if each individual publication or patent was specifically and individually indicated to be incorporated by reference. Various exemplary embodiments have been described. These and other embodiments are within the scope of the following claims.

What is claimed is:

1. An article comprising a web, the web including a plurality of continuous fibers comprising:

one or more thermoplastic semicrystalline aliphatic polyesters; and polypropylene in an amount greater than 0% and no more than 8% by weight of the web, wherein the polypropylene is present in the form of aggregates which are evenly distributed throughout the fibers;

wherein the fibers exhibit molecular orientation and extend substantially endlessly through the web;

wherein the web has at least one dimension in the plane of the web which decreases by no greater than 10% when the web is heated to a temperature above a glass transition temperature of the fibers; and further wherein the article is selected from the group consisting of a surgical drape, a surgical gown, a sterilization wrap, and a wound contact material.

2. The article of claim 1, wherein the molecular orientation of the fibers results in a bi-refringence value of at least 0.01.

3. The article of claim 1, wherein the thermoplastic aliphatic polyester is selected from the group consisting of one or more poly(lactic acid), poly(glycolic acid), poly (lactic-co-glycolic acid), polybutylene succinate, polyhydroxybutyrate, polyhydroxyvalerate, blends, and copolymers thereof.

4. The article of claim 1 further comprising a plasticizer selected from the group consisting of poly(ethylene glycol), oligomeric polyesters, fatty acid monoesters and di-esters, citrate esters, and combinations thereof.

5. The article of claim 1, further comprising a diluent selected from the group consisting of fatty acid monoester, a poly(lactic acid) oligomer, and combinations thereof.

6. The article of claim 1, further comprising a surfactant selected from the group consisting of a fluoro-organic surfactant, a silicone-functional surfactant, a salt of dioctylsulfosuccinate, and an anionic surfactant.

7. The article of claim 1, further comprising a viscosity modifier having the following structure:

$$(R—CO_2^-)_nM^{+n}$$

wherein R is an alkyl or alkylene of C8-C30 as a branched or straight carbon chain, or C12-C30 aralkyl, and may be optionally substituted with 0-100 alkylene oxide groups selected from ethylene oxide, propylene oxide groups, oligomeric lactic and/or glycolic acid, or a combination thereof;

n is the valence of M; and

M is H, an alkali metal, an alkaline earth metal, or an ammonium group.

8. The article of claim 7, wherein the ammonium group is a protonated tertiary amine, a quaternary amine, a protonated triethanolamine or a tetramethylammonium.

9. The article of claim 1, further comprising a viscosity modifier selected from the group consisting of alkyl carboxylates, alkenyl carboxylates, aralkyl carboxylates, alkylethoxylated carboxylates, aralkylethoxylated carboxylates, alkyl lactylates, alkenyl lactylates, stearoyl lactylates, stearates, and mixtures thereof.

10. The article of claim 1, further comprising an antimicrobial component selected from the group consisting of a fatty acid monoester, a fatty acid di-ester, an organic acid, a silver compound, a quaternary ammonium compound, a cationic (co)polymer, an iodine compound, or combinations thereof.

11. The article of claim 1, further comprising a thermoplastic (co)polymer distinct from the thermoplastic aliphatic polyester.

12. The article of claim 1, wherein the polypropylene is present in an amount from about 1% to about 6% by weight of the web.

13. The article of claim 1, wherein the fibers exhibit a median fiber diameter of at least 1 μm and no greater than about 25 μm.

14. The article of claim 1, further comprising a nonwoven web selected from the group consisting of a spunbond web, a blown microfiber web, a hydroentangled web, or combinations thereof.

15. An article comprising a web, the web including a plurality of fibers comprising:

one or more thermoplastic semicrystalline aliphatic polyesters; and polypropylene in an amount greater than 0% and no more than 8% by weight of the web, wherein the polypropylene is present in the form of aggregates which are evenly distributed throughout the fibers;

wherein the fibers do not exhibit molecular orientation;

wherein the web has at least one dimension in the plane of the web which decreases by no greater than 10% when the web is heated to a temperature above a glass transition temperature of the fibers; and further wherein the article is selected from the group consisting of a surgical drape, a surgical gown, a sterilization wrap, and a wound contact material.

16. The article of claim 3, wherein the thermoplastic aliphatic polyester is selected from the group consisting of one or more poly(lactic acid), polybutylene succinate, polyhydroxybutyrate, polyhydroxyvalerate, blends, and copolymers thereof.

* * * * *